US007524011B2

(12) United States Patent
Kawatoko

(10) Patent No.: US 7,524,011 B2
(45) Date of Patent: Apr. 28, 2009

(54) TEMPERATURE DETECTION METHOD AND PRINTING APPARATUS USING THE SAME

(75) Inventor: Norihiro Kawatoko, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 178 days.

(21) Appl. No.: 11/402,020

(22) Filed: Apr. 12, 2006

(65) Prior Publication Data

US 2006/0187255 A1 Aug. 24, 2006

Related U.S. Application Data

(62) Division of application No. 10/764,544, filed on Jan. 27, 2004, now Pat. No. 7,048,351.

(30) Foreign Application Priority Data

Jan. 31, 2003 (JP) ..... 2003-024322

(51) Int. Cl.
*B41J 29/38* (2006.01)

(52) U.S. Cl. ..... 347/17; 347/14; 347/19

(58) Field of Classification Search ..... 347/19, 347/17

See application file for complete search history.

(56) References Cited

U.S. PATENT DOCUMENTS 5,485,179 A * 1/1996 Otsuka et al. ..... 347/14
5,646,655 A 7/1997 Iwasaki et al.
5,751,304 A 5/1998 Hirabayashi et al.
6,126,266 A 10/2000 Numata et al. ..... 347/23
6,139,125 A * 10/2000 Otsuka et al. ..... 347/11
6,286,928 B1 * 9/2001 Kasamatsu ..... 347/23
6,572,212 B2 6/2003 Konno et al.
6,644,770 B1 11/2003 Niimura et al.
6,719,395 B2 4/2004 Iwasaki et al. ..... 347/19
6,820,955 B1 * 11/2004 Usui ..... 347/7
6,830,308 B2 * 12/2004 Hamasaki et al. ..... 347/14
2003/0025745 A1 2/2003 Kawatoko et al.

(Continued)

FOREIGN PATENT DOCUMENTS

JP 5-31916 2/1993

(Continued)

*Primary Examiner*—Luu Matthew
*Assistant Examiner*—Brian J Goldberg
(74) *Attorney, Agent, or Firm*—Fitzpatrick, Cella, Harper & Scinto

(57) ABSTRACT

Provided is a temperature detection method capable of more accurately acquiring an environmental temperature and more accurately correcting temperature detection of a printhead. In a printing apparatus to which this method is applied, a previous printing time when the printhead has performed a printing operation is stored in a nonvolatile memory. The current time is acquired using a timer which always performs a time counting operation by power supply from an auxiliary power supply capable of supplying power independently of a main power supply that supplies power for performing the printing operation by the printing apparatus. A time elapsed after the previous printing time is calculated on the basis of the current time and previous printing time. The elapsed time and a predetermined time are compared. The temperature is measured using a sensor arranged in at least one of the printing apparatus and the printhead in accordance with the comparison result. A temperature is updated on the basis of the measured temperature.

6 Claims, 20 Drawing Sheets

U.S. PATENT DOCUMENTS

2003/0025748 A1 2/2003 Kawatoko et al.

FOREIGN PATENT DOCUMENTS

JP 5-238045 9/1993
JP 6-198886 7/1994
JP 7-60996 3/1995
JP 7-209031 8/1995

* cited by examiner

FIG. 9

| TIME ELAPSED AFTER POWER-ON | 0 TO 30 MIN | 30 TO 60 MIN | 60 MIN OR MORE |
|---|---|---|---|
| ENVIRONMENTAL TEMPERATURE CORRECTION VALUE | 0.0°C | −0.5°C | −1.0°C |

TEMPERATURE DETECTION METHOD AND PRINTING APPARATUS USING THE SAME

This application is a divisional application of application Ser. No. 10/764,544, filed Jan. 27, 2004, pending.

CLAIM OF PRIORITY

This application claims priority under 35 U.S.C. §119 from Japanese Patent Application No. 2003-024322, entitled "Temperature Detection Method" and filed on Jan. 31, 2003, the entire contents of which are incorporated herein by reference.

FIELD OF THE INVENTION

This invention relates to a temperature detection method and an inkjet printing apparatus using the method and, more particularly, to a temperature detection method applied to a printing apparatus which uses an inkjet printhead.

BACKGROUND OF THE INVENTION

Printing apparatuses such as a printer, copying apparatus, and facsimile apparatus print images of dot patterns on printing media such as a paper sheet and thin plastic plate on the basis of image information. Such printing apparatuses can be classified by the printing method into an inkjet type, wire dot type, thermal type, laser beam type, and the like. Of these methods, the inkjet method (inkjet printing apparatus) prints by discharging ink droplets from the orifices of a printhead onto a printing medium.

Recently, many printing apparatuses are used in various fields. High-speed printing, high resolution, high image quality, and low noise are required for these printing apparatuses. One of printing apparatuses which meet these requirements is an inkjet printing apparatus described above. The inkjet printing apparatus can perform noncontact printing by discharging ink from the printhead, and has an advantage capable of stably printing images on various printing media.

The inkjet printing apparatus is known to suffer various problems upon changes in environmental temperature and the temperature of a printhead integrating printing elements. This is because physical values such as the viscosity and surface tension of ink change depending on the temperature. In a so-called bubble-jet printing method of generating bubbles in ink by thermal energy and discharging ink by the generated bubbles, bubble generation conditions and the like also change upon a temperature change.

If the physical values of ink or bubble generation conditions change, the discharge amount of ink droplets from the inkjet printhead or the discharge position precision to a printing medium varies. This results in density variations, density unevenness, and a tint change in a printed image.

Hence, temperature detection control is important in the inkjet printing apparatus, and various control methods have been proposed for acquisition of the environmental temperature and head temperature. Examples of these proposals are as follows.

More specifically, an example is control of correcting an environmental temperature detected in accordance with the time elapsed after power-on of a printing apparatus (see, e.g., Japanese Patent Publication Laid-Open No. 5-31916, and U.S. Pat. No. 5,751,304). Another example is control in which means for measuring a time elapsed after previous printing and a temperature detection element for measuring the current temperature of a thermal head are adopted, and the temperatures of units except the thermal head are estimated using the current head temperature and the time elapsed after previous printing (see, e.g., Japanese Patent Publication Laid-Open No. 5-238045). Still another example is control in which printhead temperature detection means and a detection control step of detecting the printhead temperature after the end of printing every lapse of prospective time are provided, and the latest detected printhead temperature is regarded as an environmental temperature (see, e.g., Japanese Patent Publication Laid-Open No. 6-198886). Still another example is control in which a temperature detection circuit for detecting a temperature on the control board of a printhead and measurement means for measuring times elapsed after power-on of a printing apparatus, soft power-on, and printing are adopted, and the temperature read timing and detection temperature correction value are changed on the basis of the combination of the measured times (see, e.g., Japanese Patent Publication Laid-Open No. 7-60996, and U.S. Pat. No. 5,646,655).

Head temperature detection elements arranged on a printhead require detection temperature correction owing to manufacturing variations. As the correction method, there is proposed a control method in which head temperature detection means and environmental temperature detection means are adopted, and the offset value of a head detection temperature is set on the basis of the head temperature and environmental temperature upon powering on a printing apparatus or exchanging a printhead (see, e.g., Japanese Patent Publication Laid-Open No. 7-209031, and U.S. Pat. No. 5,646,655).

In this manner, in order to measure power-on time of a printing apparatus or a time elapsed after previous printing, conventional temperature control requires various time measurement means which always operate as long as the printing apparatus is connected to a power supply.

In recent years, reduction in the running cost of the apparatus and measures against environmental issues attract people's keen interest, and attention is given to power consumption upon soft power-off. Demands have arisen for stopping the time measurement means inside the printing apparatus main body.

A conventional desktop printing apparatus assumes to be always connected to the power supply, whereas in general, a portable printing apparatus is not always connected to the power supply when being carried. Thus, there is a need for environmental temperature acquisition control which does not require any time measurement means that always operates like a conventional one.

The printing apparatus exhibits large power consumption and a large heat generation amount in a printing operation in comparison with a non-printing state. To minimize the influence of heat generated in the printing operation, an environmental temperature detection element has conventionally been arranged at a portion almost free from the influence of a temperature rise in the apparatus. However, as the printing apparatus is downsized, the environmental temperature detection element tends to be influenced by a temperature rise in the apparatus regardless of the position of the element in the apparatus. This indicates that an accurate environmental temperature can be no longer acquired by a conventional method. As a result, the temperature detection means of the printhead cannot perform accurate correction.

SUMMARY OF THE INVENTION

Accordingly, the present invention is conceived as a response to the above-described disadvantages of the conventional art.

For example, a temperature detection method and a printing apparatus using the method according to the present invention are capable of more accurately acquiring an environmental temperature and more accurately correcting temperature detection of a printhead.

According to one aspect of the present invention, preferably, a temperature detection method of a printing apparatus which prints by using a printhead, comprises: a storage step of storing, in a nonvolatile memory, a previous printing time when the printhead has performed a printing operation; a time acquisition step of acquiring a current time by using a timer which always performs a time counting operation by power supply from an auxiliary power supply capable of supplying power independently of a main power supply that supplies power for performing the printing operation by the printing apparatus; a calculation step of calculating a time elapsed after the previous printing time on the basis of the current time and the previous printing time; a comparison step of comparing the elapsed time and a predetermined time; a measurement step of measuring a temperature by using a sensor arranged in at least one of the printing apparatus and the printhead in accordance with the comparison result at the comparison step; and an update step of updating a temperature on the basis of the measured temperature.

Details of the above method are as follows. The temperature includes at least either of an environmental temperature of the printing apparatus and a temperature of the printhead.

Desirably, power-on time of the printing apparatus is acquired using the timer at the time acquisition step, a time elapsed after power-on is calculated from the power-on time and the current time at the calculation step, and the environmental temperature of the printing apparatus is corrected in accordance with the time elapsed after power-on.

Desirably, whether or not the printhead has been exchanged is determined, and a temperature correction value of the printhead is so controlled as to be updated in accordance with the determination result.

Desirably, the main power supply includes an AC power supply or a DC power supply, and the auxiliary power supply includes a battery.

The printhead desirably has a sensor for measuring a head temperature.

According to another aspect of the present invention, preferably, a printing apparatus which prints by using a printhead, comprises: a nonvolatile memory which stores a previous printing time when the printhead has performed a printing operation; a timer which always performs a time counting operation by power supply from an auxiliary power supply capable of supplying power independently of a main power supply that supplies power for performing the printing operation by the printing apparatus; time acquisition means for acquiring a current time by using the timer; calculation means for calculating a time elapsed after the previous printing time on the basis of the current time acquired by the time acquisition means and the previous printing time stored in the nonvolatile memory; comparison means for comparing the elapsed time and a predetermined time; measurement means for measuring a temperature by using a sensor arranged in at least one of the printing apparatus and the printhead in accordance with the comparison result by the comparison means; and update means for updating a temperature on the basis of the measured temperature.

According to still another aspect of the present invention, preferably, a temperature detection method of a printing apparatus which prints by using a printhead, comprises: a storage step of storing, in a nonvolatile memory, a previous printing time when the printhead has performed a printing operation; a time acquisition step of acquiring an absolute current time; a calculation step of calculating a time elapsed after the previous printing time on the basis of the absolute current time and the previous printing time; a comparison step of comparing the elapsed time and a predetermined time; a measurement step of measuring a temperature by using a sensor arranged in at least one of the printing apparatus and the printhead in accordance with the comparison result at the comparison step; and an update step of updating a temperature on the basis of the measured temperature.

According to still another aspect of the present invention, preferably, a printing apparatus which prints by using a printhead, comprises: a nonvolatile memory which stores a previous printing time when the printhead has performed a printing operation; time acquisition means for acquiring an absolute current time; calculation means for calculating a time elapsed after the previous printing time on the basis of the absolute current time acquired by the time acquisition means and the previous printing time stored in the nonvolatile memory; comparison means for comparing the elapsed time and a predetermined time; measurement means for measuring a temperature by using a sensor arranged in at least one of the printing apparatus and the printhead in accordance with a comparison result by the comparison means; and update means for updating a temperature on the basis of the measured temperature.

The invention is particularly advantageous since the time counting operation can still continue even if supply from the main power supply of the printing apparatus stops, and the temperature can be more accurately detected without any influence of stopping supply from the main power supply.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

FIG. 6 is a flow chart showing a general printing apparatus activation sequence upon power-on;

FIG. 9 is a table showing the relationship between the time elapsed after power-on and the environmental temperature correction value;

DETAILED DESCRIPTION OF THE PREFERRED EMBODIMENTS

Preferred embodiments of the present invention will now be described in detail in accordance with the accompanying drawings.

In this specification, the terms "print" and "printing" not only include the formation of significant information such as characters and graphics, but also broadly includes the formation of images, figures, patterns, and the like on a print medium, or the processing of the medium, regardless of whether they are significant or insignificant and whether they are so visualized as to be visually perceivable by humans.

Also, the term "print medium" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid" hereinafter) should be extensively interpreted similar to the definition of "print" described above. That is, "ink" includes a liquid which, when applied onto a print medium, can form images, figures, patterns, and the like, can process the print medium, and can process ink (e.g., can solidify or insolubilize a coloring agent contained in ink applied to the print medium).

Furthermore, unless otherwise stated, the term "nozzle" generally means a set of a discharge orifice, a liquid channel connected to the orifice and an element to generate energy utilized for ink discharge.

Figure 1:
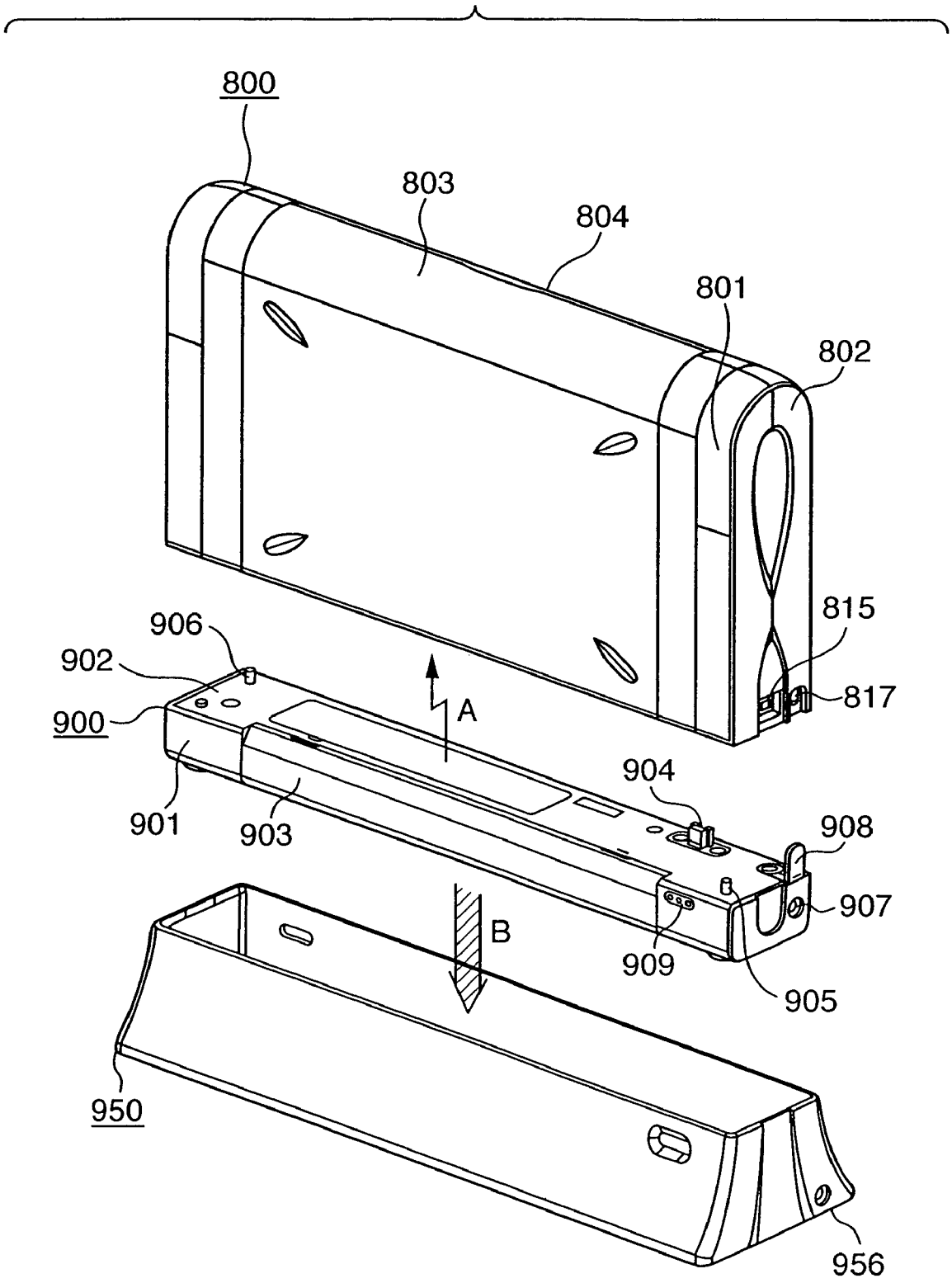
FIG. 1 is a perspective view showing the overall arrangement of an inkjet printing apparatus as a typical embodiment of the present invention.

FIG. 1 is a perspective view showing the overall arrangement of an inkjet printing apparatus (hereinafter referred to as "printing apparatus") operable with both AC and DC power sources according to a typical embodiment of the present invention. As shown in FIG. 1, the printing apparatus includes an inkjet printer 800 (referred to as "printer"), a battery charger 900 which incorporates a battery and is detachable from the printer main body, and a cradle 950 serving as a mount for vertically housing the printer and battery charger while attaching them. A paper sheet will be exemplified as a printing medium for printing by the printer. The present invention is not limited to this, and can be applied to any printable sheet-like medium.

In FIG. 1, the outer appearance of the printer 800 is an integral shell structure comprised of an upper case 801, lower case 802, feed cover 803, and discharge port cover 804. The printer 800 takes this form when it is not used (stands still or is carried). The side surface of the printer 800 has a "DC in" jack (DC power input jack) 817 for inserting an AC adapter cable (not shown) used when power is supplied from an AC power source, and an I/F (interface) connector 815 for connecting a USB cable. The feed cover 803 functions as a printing sheet supply tray which is opened from the printer main body to support a printing sheet such as a paper sheet in printing.

The outer appearance of a battery charger 900 is comprised of a main case 901, cover case 902, and battery lid 903. The battery lid 903 is detached to open the main case 901, allowing removing a battery pack integrating a battery.

The mounting surface (connection surface) of the battery charger 900 to the printer 800 has a main body connector 904 for electrical connection, and fixing screws 905 and 906 for mechanical attachment and fixing. The battery charger 900 is connected to the printer main body in a direction indicated by an arrow A in FIG. 1 to drive the printer 800 by the battery. The top surface of the battery charger 900 has a charge indicator 909 which indicates the residual capacity of the battery. The side surface of the battery charger 900 has a "CHG-DC in" jack 907 for inserting the AC adapter cable, and a cover plate 908 for covering the "DC in" jack 817 of the printer 800 when the battery charger 900 is attached.

A cradle 950 functions as a mount by inserting the printer 800 in a direction indicated by an arrow B in FIG. 1 while the battery charger 900 is attached to the printer 800. Note that the cradle 950 has an opening 950 so that the printer 800 can be charged by inserting the AC adapter cable into "CHG-DC in" jack 907 even when the battery charger 900 and the printer 800 are attached to the cradle 950.

Figure 2:
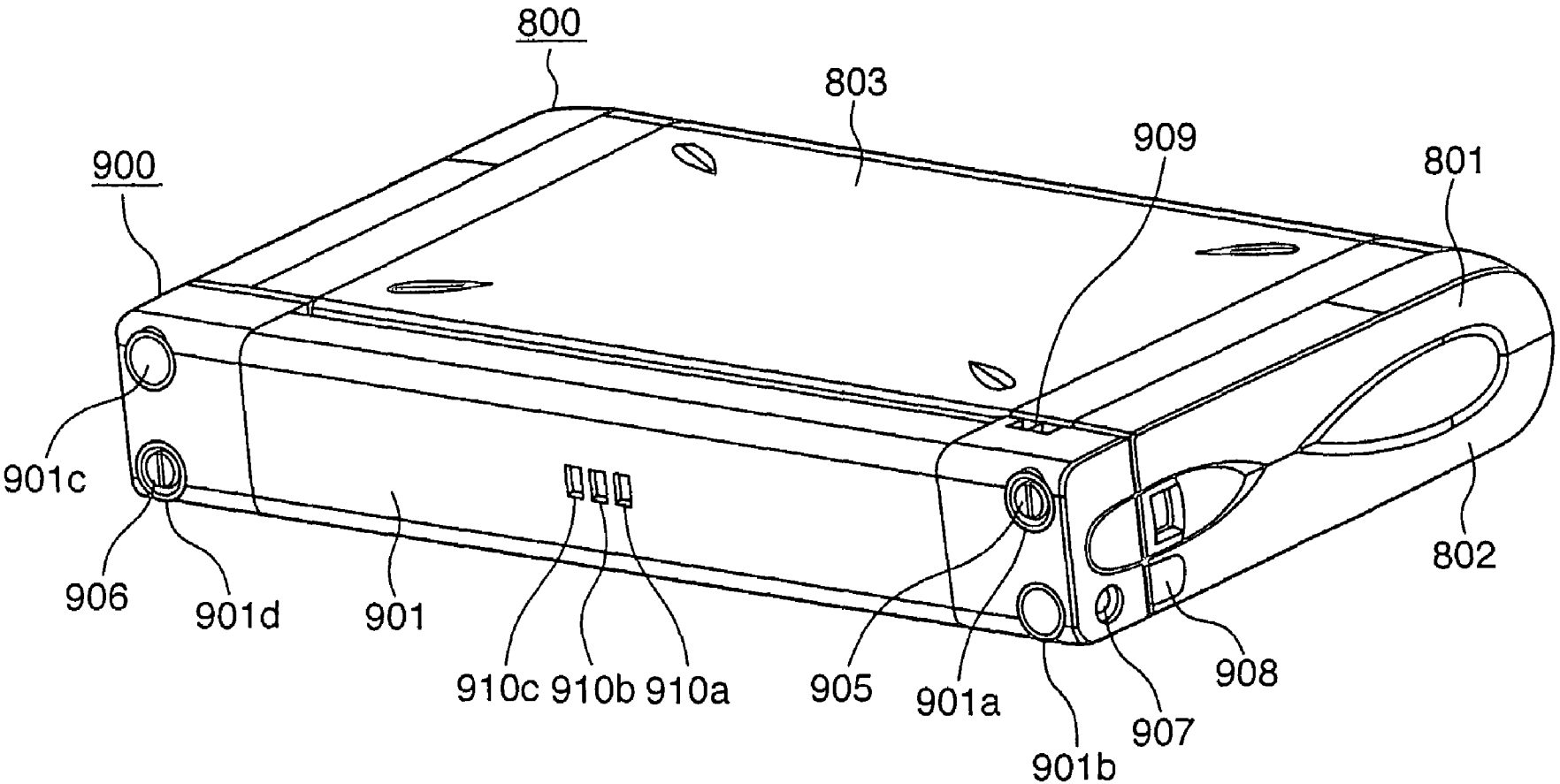
FIG. 2 is a perspective view of an inkjet printer in FIG. 1 to which a battery charger is attached.

FIG. 2 is a perspective view showing a state in which the battery charger 900 is mounted on the printer 800 when the printer back surface and printer top surface are viewed diagonally from the top.

As shown in FIG. 2, the battery charger 900 is attached to the back surface of the printer 800, and fixed with the fixing screws 905 and 906 so that the printer 800 becomes a battery-driven printer.

As described above, the "DC in" jack 817 of the printer 800 is covered with the cover plate 908 of the battery charger 900. In attaching the battery charger 900, a user reliably inserts the AC adapter cable to the "CHG-DC in" jack 907 of the battery charger 900, thus preventing erroneous insertion.

The back surface of the battery charger 900 has four legs 901*a*, 901*b*, 901*c*, and 901*d* on the main case 901. This back surface also has contacts 910*a*, 910*b*, and 910*c* for electrical contact upon attachment to the cradle 950.

As shown in FIG. 2, the charge indicator 909 of the battery charger 900 is arranged at a position where, even when the feed cover 803 is opened, the feed cover 803 does not interrupt visual recognition on the top surface on which the charge indicator 909 can be easily visually recognized in mounting or using the printer 800.

Figure 3:
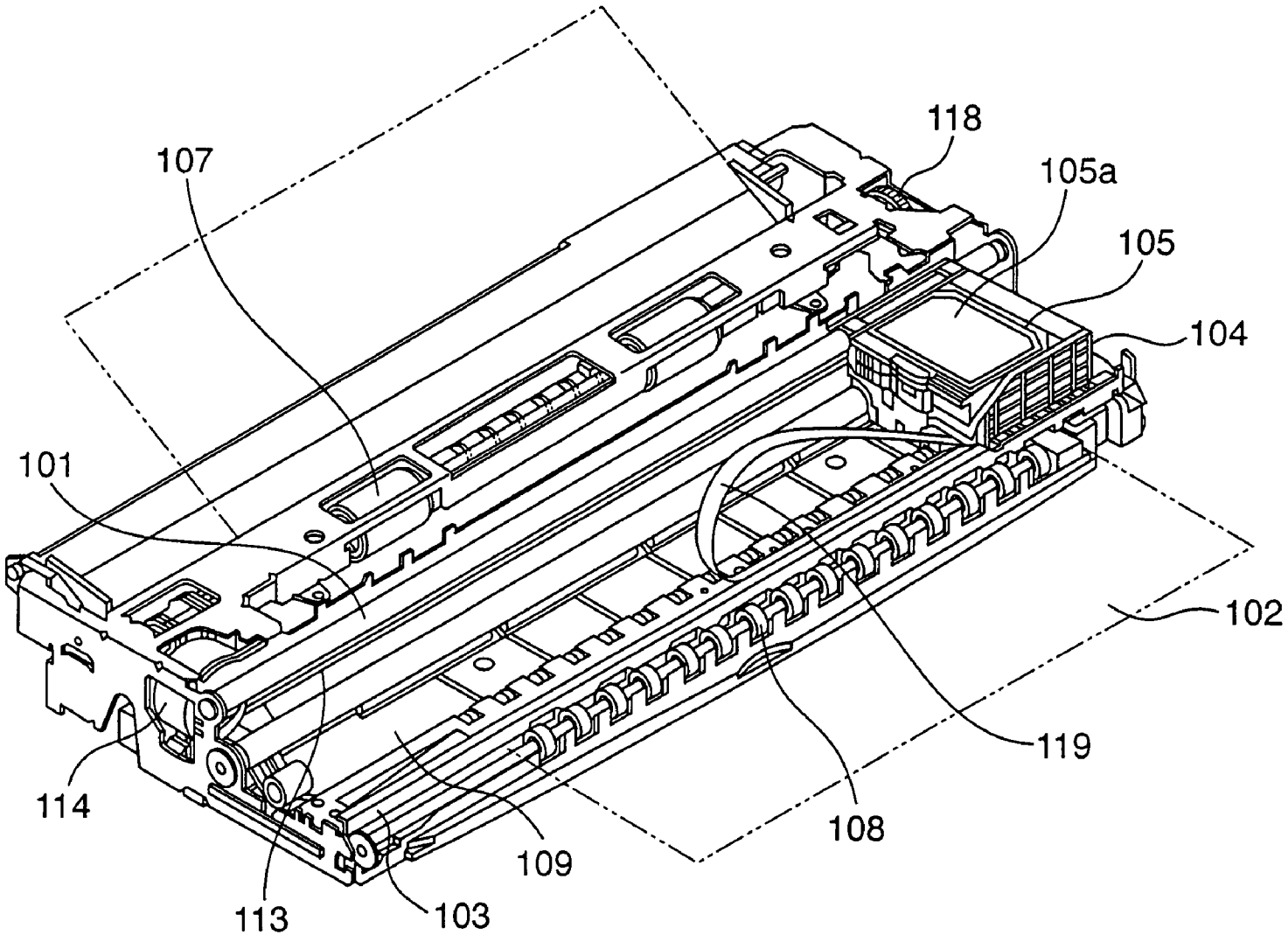
FIG. 3 is a perspective view showing the internal structure of a printer 800.

FIG. 3 is a perspective view showing the internal structure of the printer 800.

As shown in FIG. 3, a printhead 105, mounted on a carriage 104, is reciprocated in a lengthwise direction along a guide rail 103. Ink discharged from the printhead 105 is attached to a printing medium 102 where its printing surface is regulated on a platen (not shown) with a slight interval from the printhead 105, and forms an image on the print medium.

The printhead 105 is supplied with a print signal via a flexible cable 119 in correspondence with image data.

Note that in FIG. 3, numeral 114 denotes a carriage motor to scan-move the carriage 104 along the guide rail 103. Numeral 113 denotes a carriage belt to transmit a driving force of the carriage motor 114 to the carriage 104. Further, numeral 118 denotes a conveyance motor connected to a conveyance roller 101 to convey the printing medium 102.

Further, the printhead 105, connected to an ink tank 105*a*, constructs a head cartridge. As the structure of the head cartridge, the printhead and the ink tank may be separable from each other or may be integral with each other.

Further, numeral 107 denotes a pickup roller to pickup the printing medium 102 upon paper feed and guide the printing medium into the apparatus. Numeral 108 denotes a paper discharge roller to discharge the printing medium 102 to the outside of the apparatus upon paper discharge.

Almost all the above mechanical parts are attached to a base chassis 109 of the apparatus.

Figure 4:
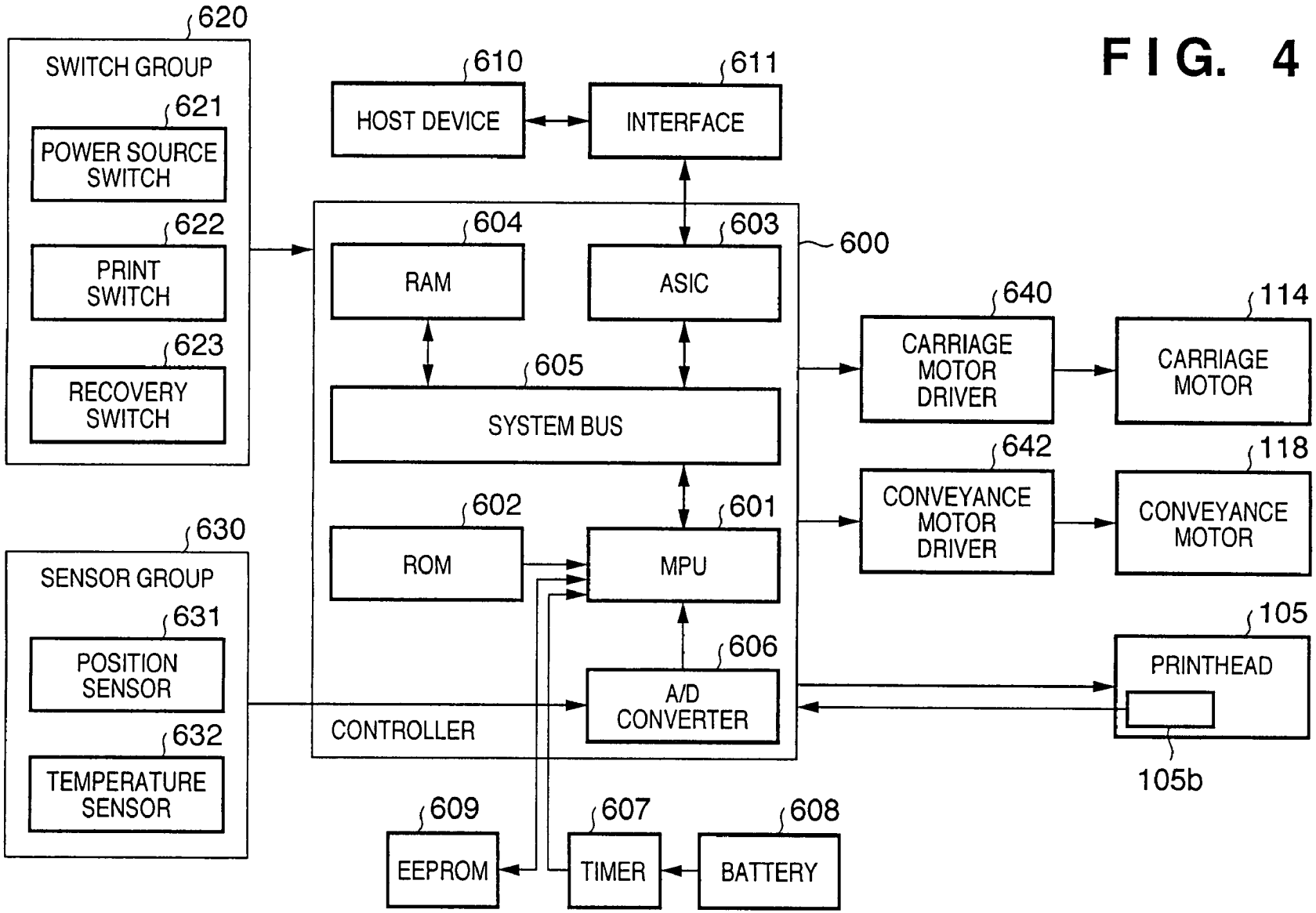
FIG. 4 is a block diagram showing a control construction of the printer 800 shown in FIGS. 1 to 3.

FIG. 4 is a block diagram showing a control construction of the printer 800 shown in FIGS. 1 to 3.

As shown in FIG. 4, a controller 600 has an MPU 601, a ROM 602 holding a program corresponding to a control sequence to be described later, a required table, and other fixed data, an Application Specific Integrated Circuit (ASIC) 603 to generate control signals for controlling the carriage motor 114, the conveyance motor 118 and a printhead 105, a RAM 604 having an image data mapping area and a work area for execution of program, a system bus 605 interconnecting the MPU 601, the ASIC 603 and the RAM 604 for data transmission/reception, an A/D converter 606 to input analog signals from a sensor group to be described later and A/D convert the signals and supply digital signals to the MPU 601, and the like.

Further, in FIG. 4, numeral 610 denotes a computer (or a reader for image reading or digital camera) as an image data supply source generically called a host device. Image data, commands, status signals and the like are transmitted/received between the host device 610 and the printing apparatus via an interface (I/F) 611.

Further, numeral 620 denotes a switch group including switches for receiving instruction inputs from an operator such as a power source switch 621, a print switch 622 for print start instruction, and a recovery switch 623 for instruction of start of processing (recovery processing) to maintain ink discharge performance of the printhead 105 in excellent status. Numeral 630 denotes a sensor group for detection of apparatus status including a position sensor 631 such as a photo coupler for home position detection, a temperature sensor 632 provided in an arbitrary position of the printing apparatus for detection of environmental temperature, and the like.

Further, numeral 640 denotes a carriage motor driver which drives the carriage motor 114 to reciprocate-scan the carriage 104 along the guide rail 103. Numeral 642 denotes a conveyance motor driver which drives the conveyance motor 118 to convey the printing medium 102.

Upon print scanning by the printhead 105, the ASIC 603 transfers drive data (DATA) for printing elements (discharge heaters) to the printhead while directly accessing the storage area of the ROM 602.

Note that the printhead 105 includes a head temperature sensor 105*b* for measurement of head temperature.

Further, the printer 800 is provided with a timer 607 which can operate with electric power supply from a small battery (a lithium battery, a nickel hydride battery, an alkali button battery, a silver oxide battery, a zinc-air battery or the like) 608 as another power source independent of a main power source such as AC or DC power sources so that the timer can continue its clocking operation even when electric power supply from the AC and DC power sources is stopped. Time counted by the timer 607 is stored in a nonvolatile memory 609 such as an EEPROM. Note that as the nonvolatile memory, an FeRAM, an MRAM and the like may be used in addition to the EEPROM.

Temperature detection processing applied to the printing apparatus having the above arrangement will be explained. To make the features of the present invention clearer, generally applied temperature detection processing will be described first, and then several embodiments according to the present invention will be described.

<General Temperature Detection>

Figure 5:
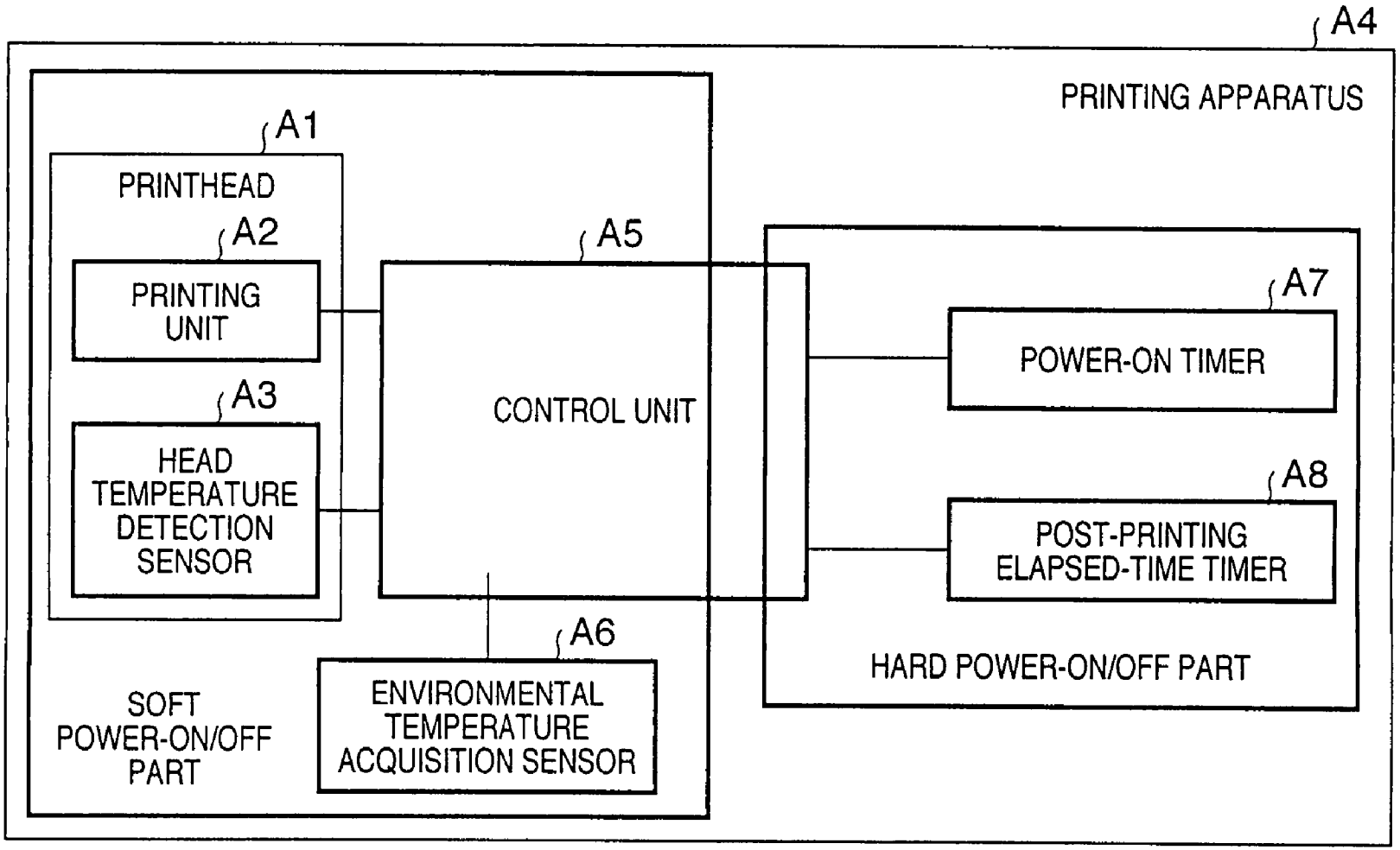
FIG. 5 is a block diagram showing the temperature detection arrangement of a general inkjet printing apparatus.

FIG. 5 is a block diagram showing the temperature detection arrangement of a general inkjet printing apparatus (to be referred to as a printing apparatus hereinafter).

As shown in FIG. 5, in order to detect the printhead temperature and the temperature (environmental temperature) of an environment where the printing apparatus is installed, a printing apparatus A4 comprises: a printhead A1 formed by a printing unit A2 having a plurality of printing elements and a head temperature detection sensor A3; a control unit A5 formed by a CPU, memory, and the like; an environmental temperature acquisition sensor A6; a power-on timer A7 which always operates during hard power-on; and a post-printing elapsed-time timer A8 which measures a time elapsed after printing by the printhead A1.

A general environmental temperature acquisition sequence and head temperature correction sequence will be explained with reference to FIGS. 6 to 8.

Figure 6:
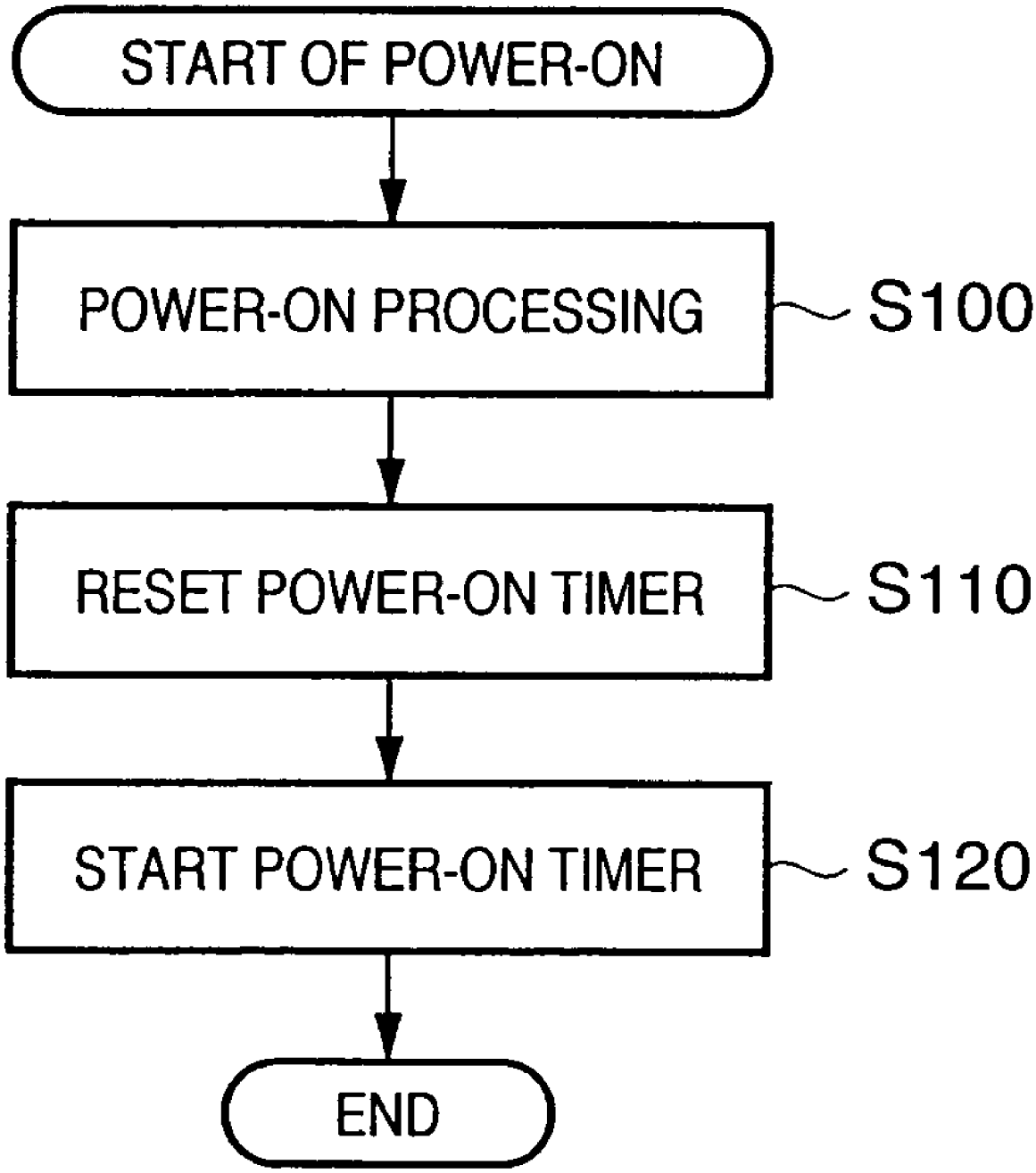

FIG. 6 is a flow chart showing a general apparatus activation sequence upon power-on.

When the printing apparatus is powered on (power-on), various preparation operations (power-on processing) including confirmation of the home position of the carriage position are performed in step S100. In step S110, the power-on timer A7 which counts the power-on time is reset. In step S120, the power-on timer A7 starts.

In this manner, power-on processing ends.

The power-on timer A7 always counts an elapsed time while the printing apparatus A4 is being powered on. When the control unit A5 requests the power-on time, the power-on timer A7 sends back a time elapsed after power-on.

Generally, hard power-off and soft power-off are discriminated from each other, and power-on in FIG. 6 is hard power-on (in the following description, power-on/off is hard power-on/off unless otherwise specified). In a soft power-off state, various timers continue counting the time.

Figure 7:
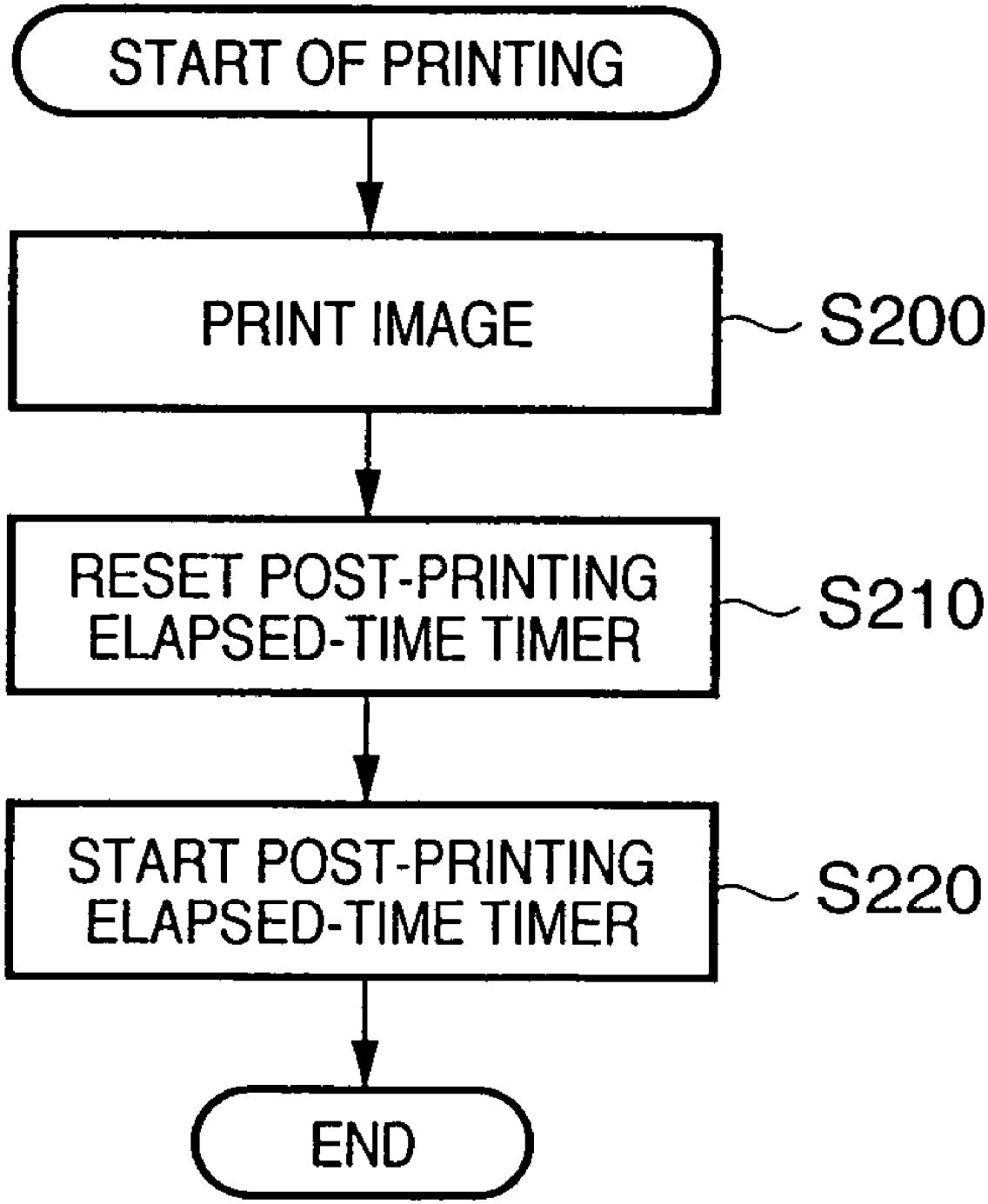
FIG. 7 is a flow chart showing a general timer control in printing operation.

FIG. 7 is a flow chart showing general timer control in printing operation.

When printing operation starts, an image is printed in step S200. The post-printing elapsed-time timer A8 is reset in step S210, and starts in step S220.

The post-printing elapsed-time timer A8 counts a time elapsed after a previous printing time, and always continues counting the time during power-on. When the control unit A5 requests a time elapsed after printing, the post-printing elapsed-time timer A8 sends back a time elapsed after the previous printing time.

Figure 8:
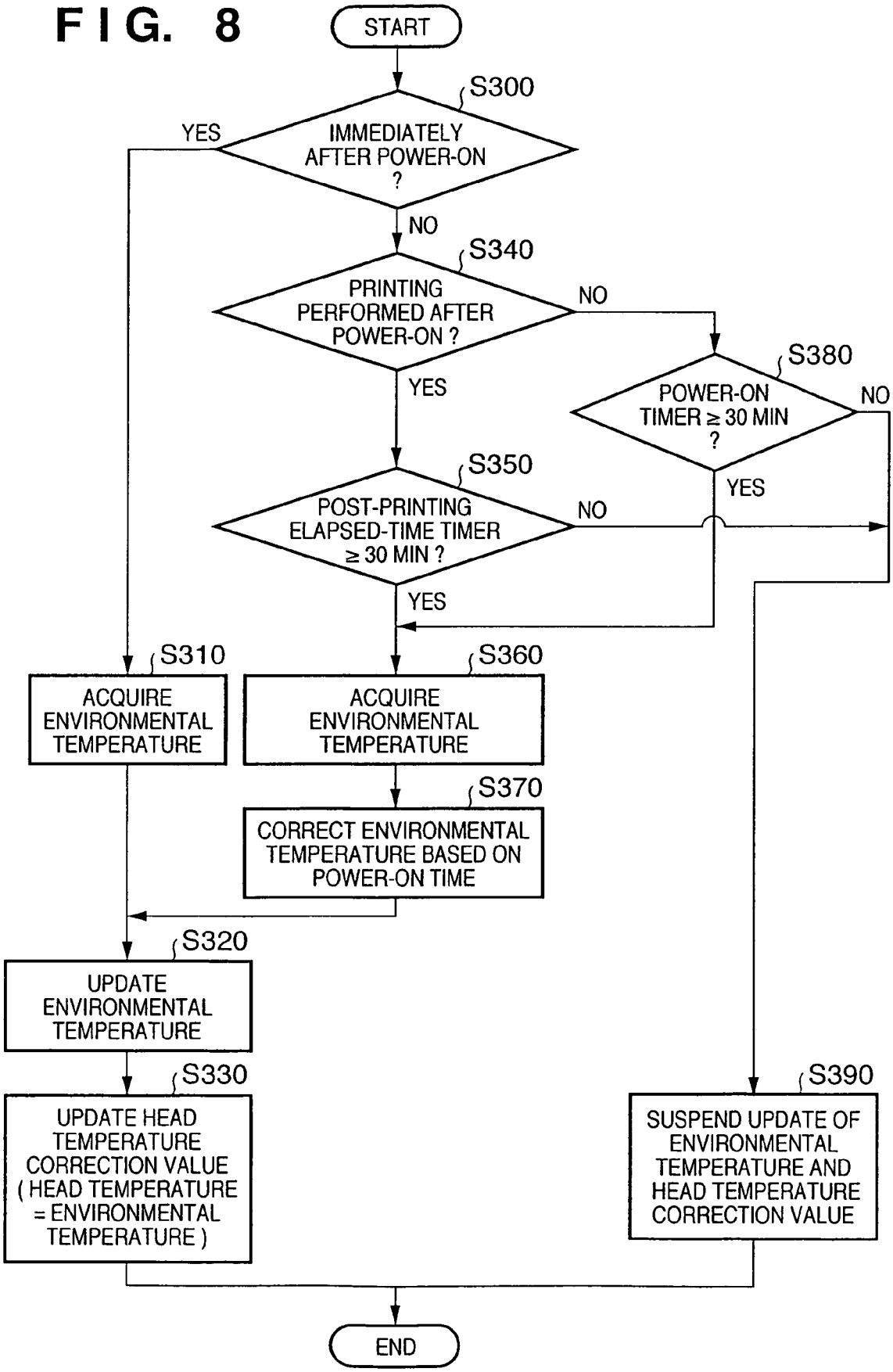
FIG. 8 is a flow chart showing a general environmental temperature acquisition & head temperature correction value update sequence.

FIG. 8 is a flow chart showing a general environmental temperature acquisition & head temperature correction value update sequence.

When the environmental temperature acquisition & head temperature correction value update sequence starts, whether or not the start timing is immediately after power-on is determined in step S300. If "YES" in step S300, the temperature in the apparatus is considered to hardly rise, and the processing advances to step S310 to acquire an environmental temperature. In step S320, the environmental temperature is updated to the latest one in accordance with the acquisition result. In step S330, a head temperature ($T_{HEAD}$) and environmental temperature ($T_{ENVR}$) are regarded to be equal to each other. The "head temperature correction value" for correcting variations in head temperature detection elements is updated, and then the processing ends.

The head temperature correction value is described in detail in Japanese Patent Publication Laid-Open No. 7-209031. In short, the offset value of a temperature detection element (temperature sensor) in a printhead is determined and used to suppress a temperature detection error caused by the manufacturing error of the temperature detection element so as to more accurately detect a temperature.

If "NO" in step S300, the processing advances to step S340 to determine whether or not printing has been done after power-on. If "YES" in step S340, the processing advances to step S350 to confirm the measurement value ($T_{laps}$) of the post-printing elapsed-time timer A8 and determine whether or not 30 minutes or more have elapsed after the previous printing time.

If $T_{laps} \geqq 30$ minutes, the processing advances to step S360 to acquire the environmental temperature ($T_{ENVR}$). In this case, the temperature in the apparatus rises due to power-on, and environmental temperature correction based on the time elapsed after power-on is executed in step S370.

FIG. 9 is a table showing the relationship between the time elapsed after power-on and the environmental temperature correction value. In step S370, an environmental temperature correction value is obtained from the detected environmental temperature ($T_{ENVR}$) and the time elapsed after power-on in accordance with the table shown in FIG. 9. An actual environmental temperature is obtained using the correction value. After that, the processing advances to step S320.

If $T_{laps} < 30$ minutes is determined in step S350, the temperature detection element, actual environmental temperature, and head temperature are considered not to be in an equilibrium state. The processing advances to step S390 to suspend update of the environmental temperature and head temperature correction value, and then the processing ends.

If "NO" in step S340, the processing advances to step S380 to confirm the measurement value ($T_{plapse}$) of the power-on timer A7 and determine whether or not the measurement value represents 30 minutes or more. If $T_{plapse} \geqq 30$ minutes, the processing advances to step S360 to acquire an environmental temperature, correct and update the environmental temperature, and update the head temperature correction value. If $T_{plapse} < 30$ minutes is determined, the processing advances to step S390 to suspend Update of the environmental temperature and head temperature correction value, and then the processing ends.

Figure 10:
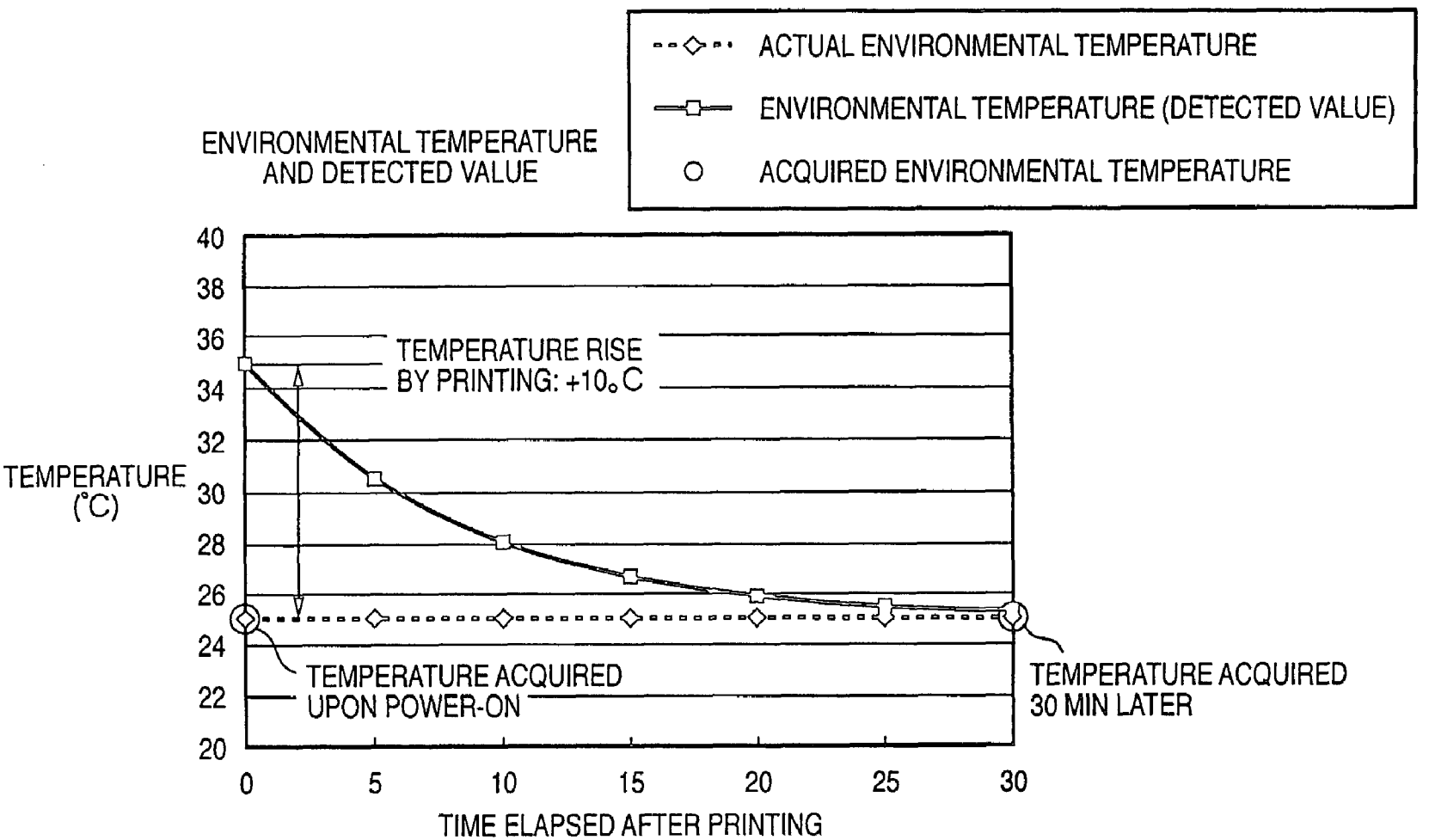
FIG. 10 is a graph showing a change in environmental temperature detected in the general environmental temperature acquisition & head temperature correction value update sequence.

FIG. 10 is a graph showing a change in environmental temperature detected in the general environmental temperature acquisition & head temperature correction value update sequence.

In FIG. 10, the solid line represents an environmental temperature output from an environmental temperature detection element, and the dotted line represents an actual environmental temperature. In FIG. 10, when the environmental temperature detection element is readily influenced by a temperature rise caused by printing, a detected temperature greatly deviates from an actual environmental temperature immediately after printing. The deviation gradually decreases, and the detected environmental temperature and actual environmental temperature return to be almost in the equilibrium state 30 minutes later.

Figure 11:
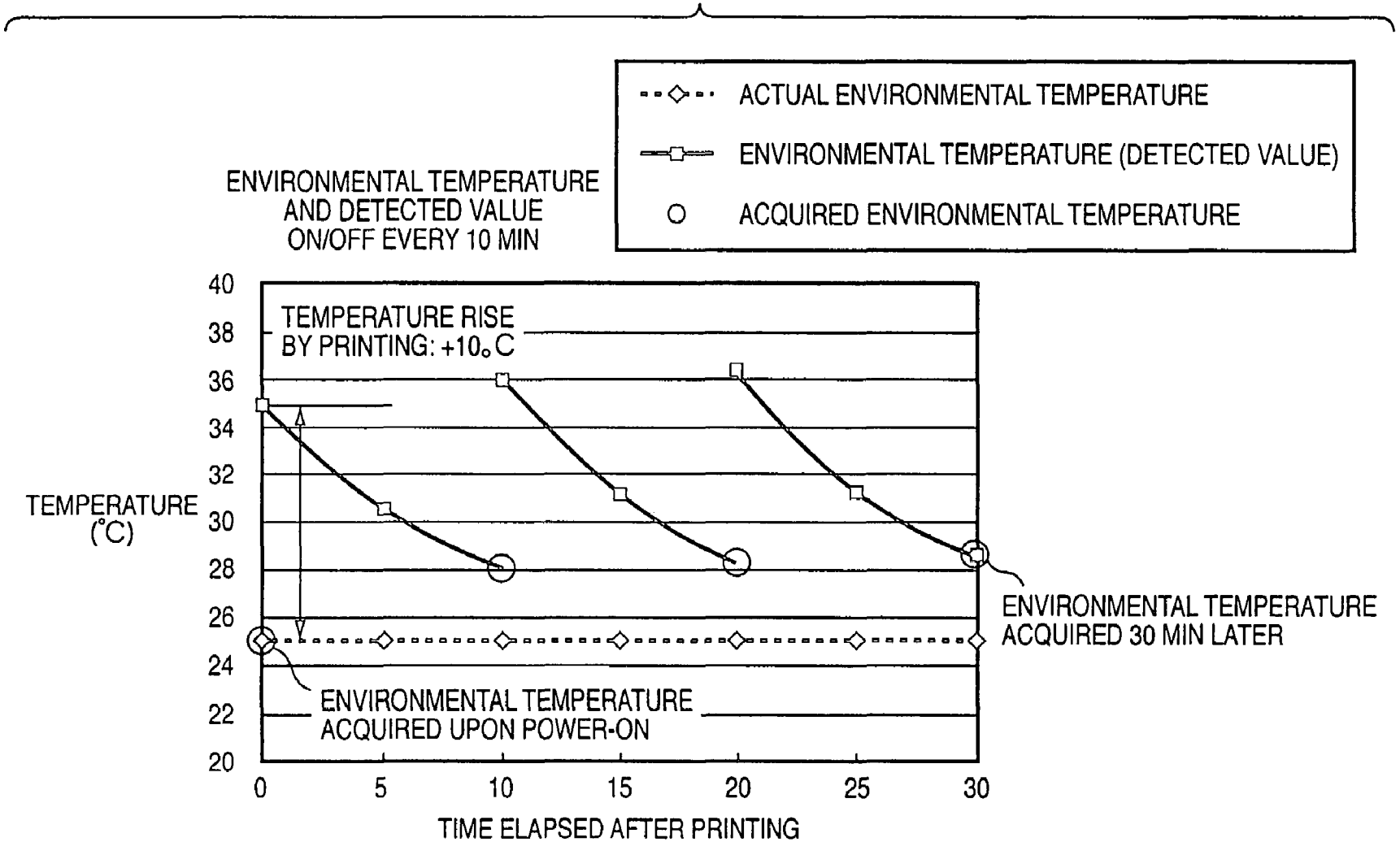
FIG. 11 is a graph showing a change in environmental temperature detected when hard power-off/on and printing are repeated three times every 10 minutes in the general environmental temperature acquisition & head temperature correction value update sequence.

FIG. 11 is a graph showing a change in environmental temperature detected when hard power-off/on and printing are repeated three times every 10 minutes in the general environmental temperature acquisition & head temperature correction value update sequence. In FIG. 11, after an environmental temperature detected by printing operation deviates by about 10° C., the environmental temperature and head temperature correction value are updated by power-off/on before the detected environmental temperature and actual environmental temperature return to the equilibrium state. Therefore, an environmental temperature measured 30 minutes after the first power-on is different by about 3° C. from an actual environmental temperature.

In a conventional desktop printing apparatus, the situation in which hard power-on/off is executed is limited, and soft power-on/off is usually used. For this reason, various timers in the printing apparatus operate. Thus, this results in avoiding the problem shown in FIG. 11. However, a printing apparatus such as a portable printing apparatus which is frequently powered off for carrying it, or a printing apparatus in which various operations stop and the status of the apparatus changes to a state identical to the hard power-off state even during soft power-off in order to reduce power consumption in the standby state does not have any time measurement means during power-off, and the problem as shown in FIG. 11 occurs.

First Embodiment

Considering the above-described general temperature detection, the first embodiment eliminates the difference between an acquired environmental temperature and an actual environmental temperature by providing in a printing apparatus a timer which operates by a separate power supply such as a button battery different from the main power supply and manages an absolute time, and managing the latest printing time.

Figure 12:
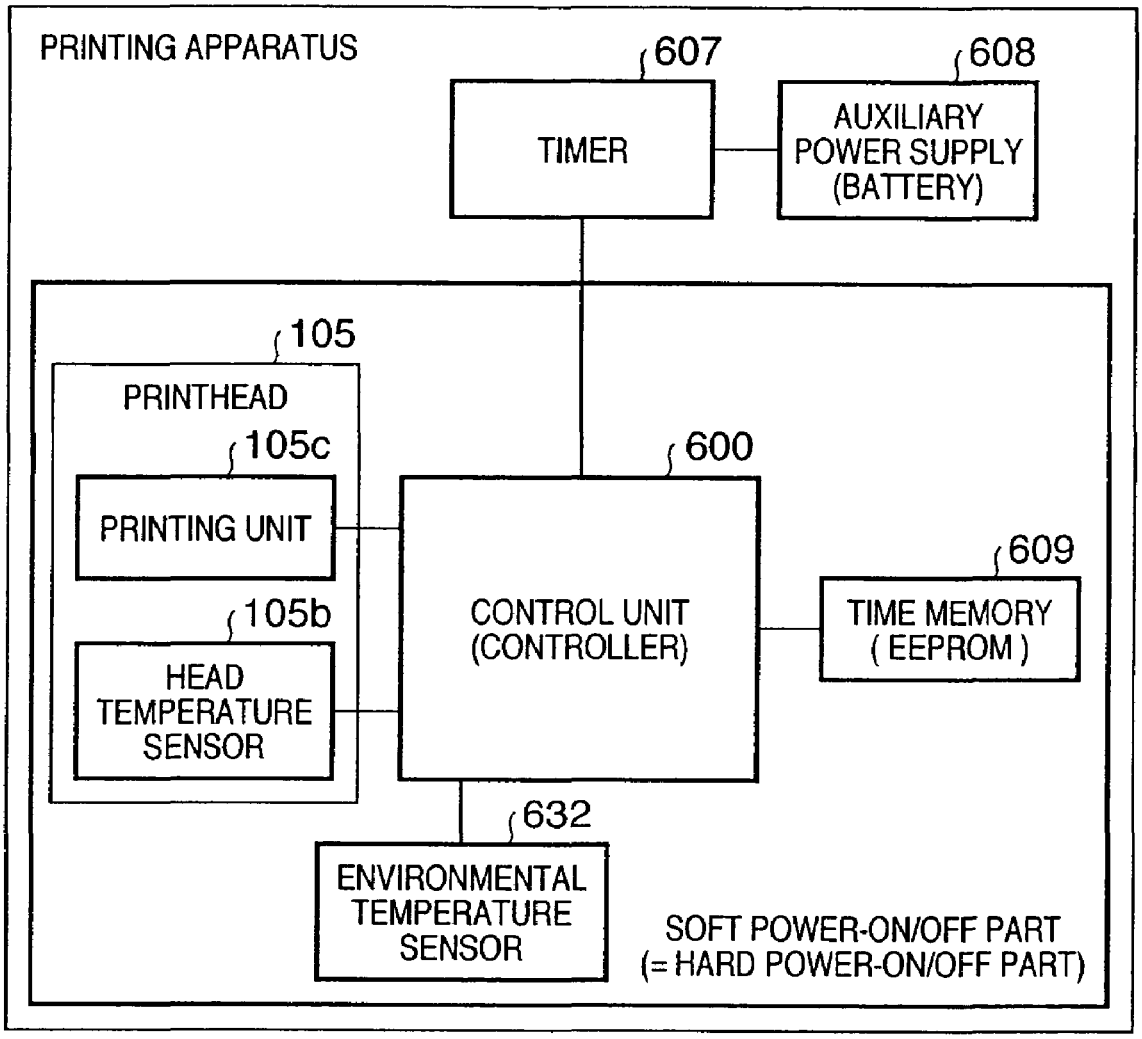
FIG. 12 is a block diagram showing the temperature detection arrangement of a printing apparatus according to a first embodiment of the present invention.

FIG. 12 is a block diagram showing the temperature detection arrangement of a printing apparatus according to the first embodiment of the present invention. A printer 800 has an overall control arrangement shown in FIG. 4. FIG. 12 focuses on only the temperature detection arrangement.

As shown in FIG. 12, in order to detect temperatures, the printing apparatus according to the first embodiment comprises: the printhead 105 formed by the head temperature sensor 105*b* and a printing unit 105*c* having a plurality of printing elements; the control unit (controller) 600; the environmental temperature sensor 632; the time memory 609 such as an EEPROM which can hold the memory even during power-off; and the timer 607 which always operates by an auxiliary power supply such as the battery 608 and manages an absolute time.

Figure 13:
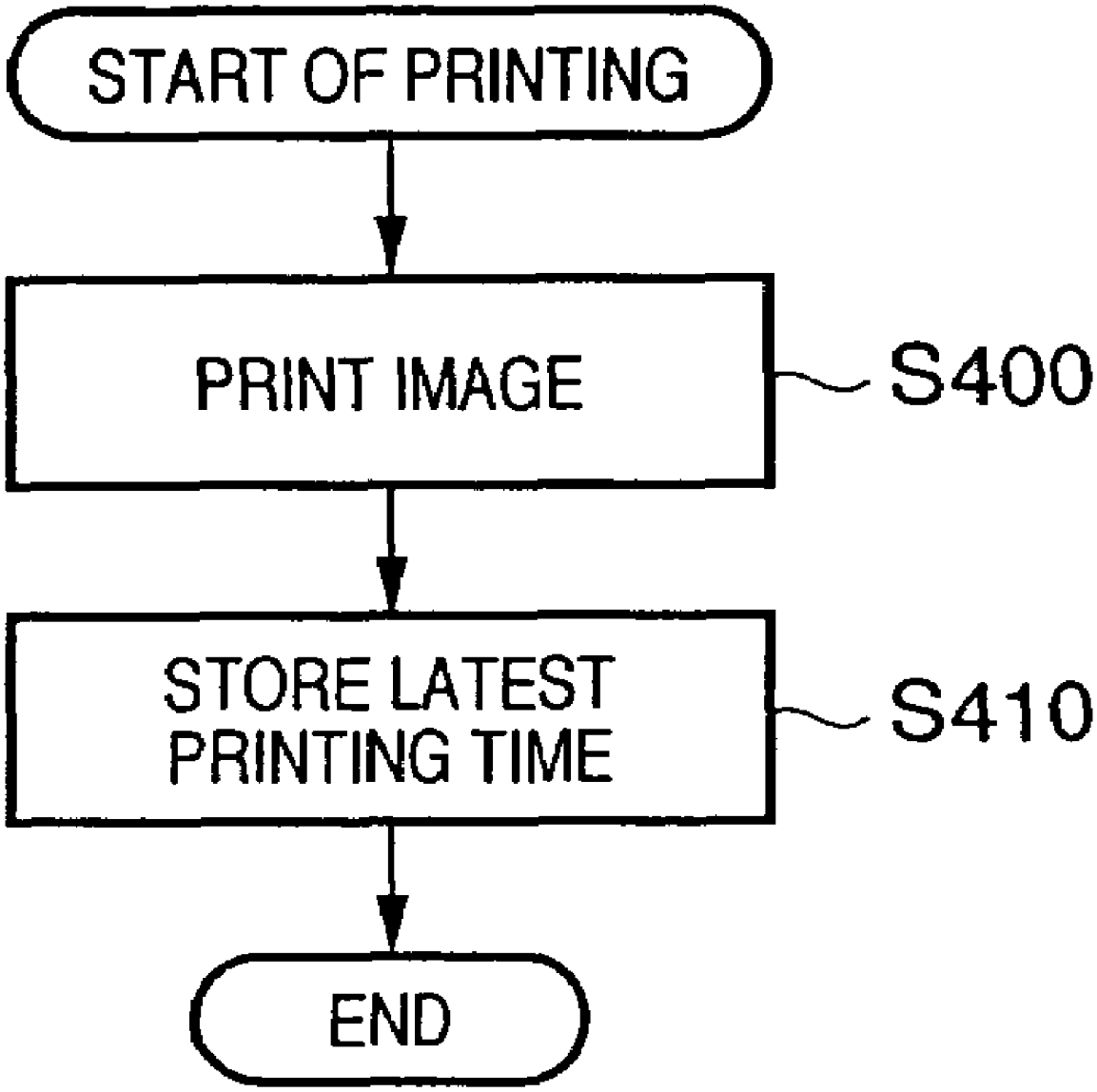
FIG. 13 is a flow chart showing a printing operation according to the first embodiment of the present invention.

FIG. 13 is a flow chart showing the printing operation according to the first embodiment.

When printing operation starts, an image is printed in step S400 while reciprocally scanning the printhead 105. After the end of printing, the latest printing time obtained by the timer 607 which manages an absolute time is saved in the nonvolatile memory 609 in step S410.

Figure 14:
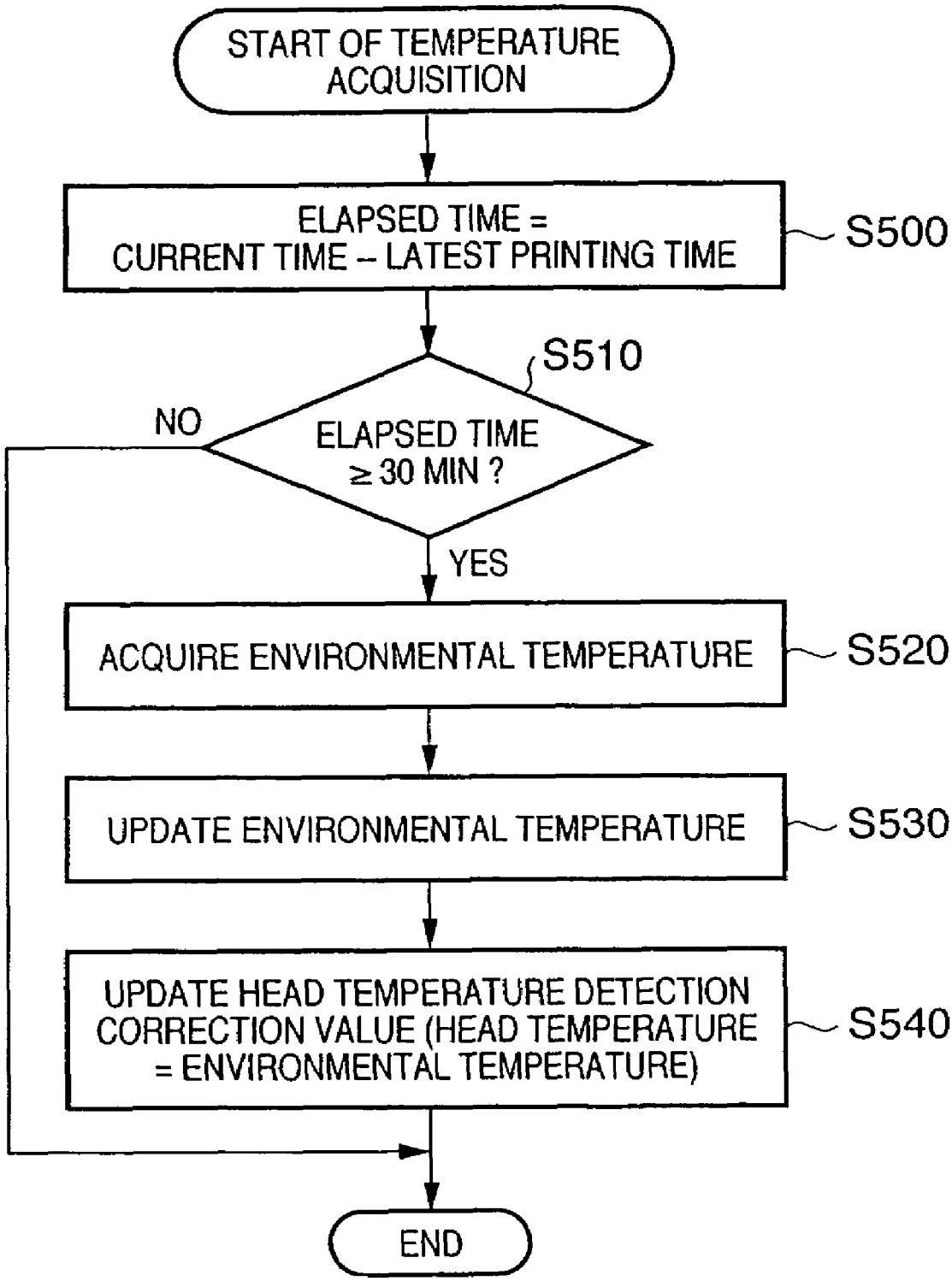
FIG. 14 is a flow chart showing temperature acquisition processing according to the first embodiment of the present invention.

FIG. 14 is a flow chart showing temperature acquisition processing according to the first embodiment.

When the temperature acquisition sequence starts, an elapsed time is obtained from the difference between the current time obtained by the timer 607 which manages the absolute time and the latest printing time held in the nonvolatile memory 609 in step S500.

In step S510, whether or not the elapsed time ($T_{laps}$) exceeds 30 minutes is determined.

If $T_{laps} \geqq 30$ minutes, the detected environmental temperature and actual environmental temperature are determined to satisfactorily settle into the equilibrium state. The processing advances to step S520 to acquire an environmental temperature ($T_{ENVR}$) In step S530, the environmental temperature is updated to the latest one. In step S540, the head temperature detection correction value is updated. In this case, a head temperature ($T_{HEAD}$) and the environmental temperature ($T_{ENVR}$) are regarded to be equal to each other.

Thereafter, the processing ends.

If $T_{laps} < 30$ minutes, the processing ends without acquiring any environmental temperature and updating any head temperature detection correction value.

Figure 15:
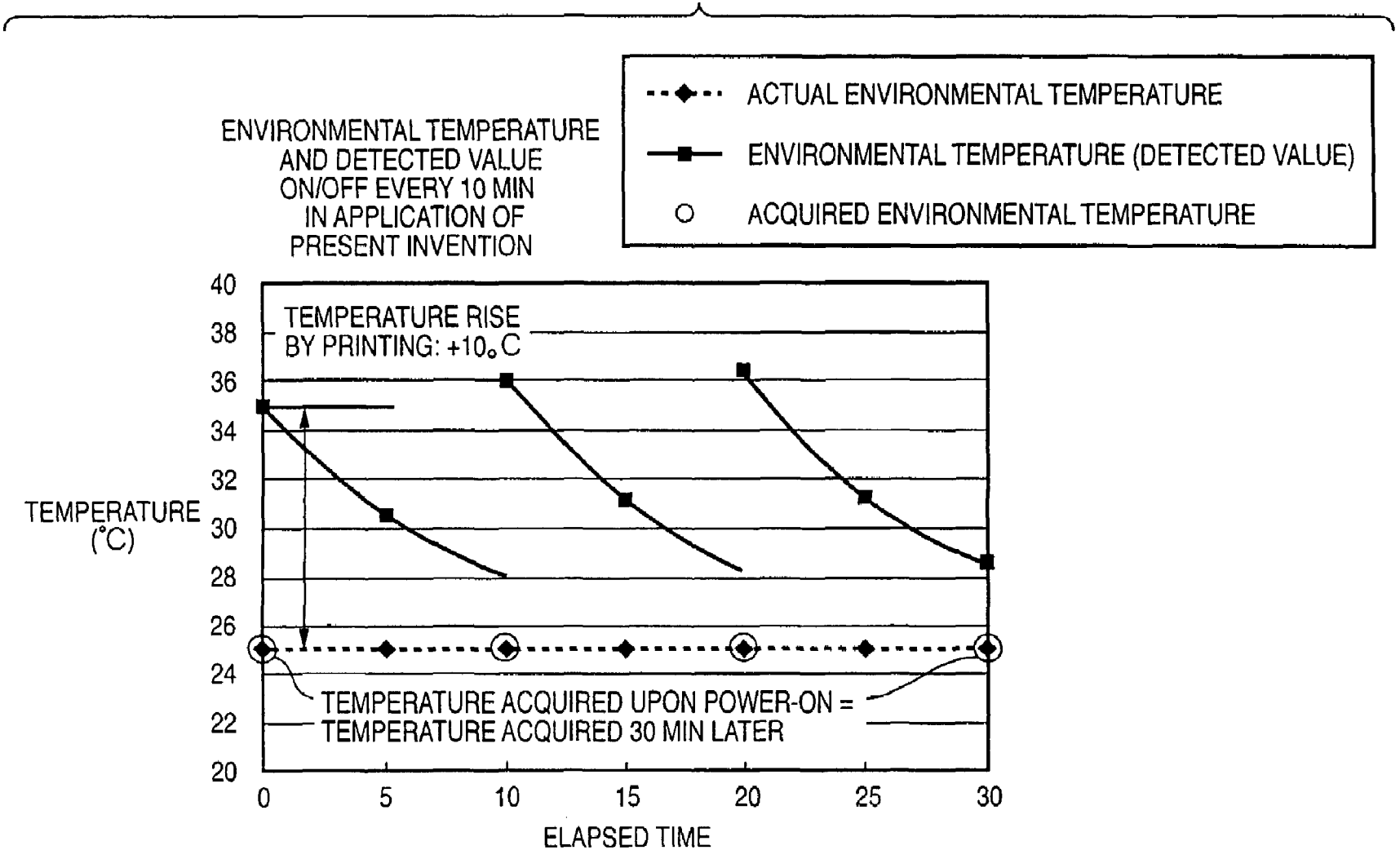
FIG. 15 is a graph showing a change in environmental temperature detected when hard power-off/on and printing are repeated three times every 10 minutes and an environmental temperature acquired after 30 minutes in an environmental temperature acquisition & head temperature correction value update sequence according to the first embodiment of the present invention.

FIG. 15 is a graph showing a change in environmental temperature detected when hard power-off/on and printing are repeated three times every 10 minutes and an environmental temperature acquired after 30 minutes in the environmental temperature acquisition & head temperature correction value update sequence according to the first embodiment.

As is apparent from a comparison between FIGS. 15 and 11, no environmental temperature is updated within 30 minutes after the latest printing time according to the first embodiment. The acquired environmental temperature holds an actual environmental temperature of 25° C. regardless of repetitive power-off/on and printing.

According to the first embodiment described above, various time counting operations which are generally performed are replaced with a time counting operation by one timer which operates by power supply from a battery even after power-off of the printing apparatus (no power is supplied from AC and DC power supplies) and can manage an absolute time. The latest printing time is managed, and only when a time elapsed after the latest printing time is 30 minutes or more, acquisition of the environmental temperature and update of the head temperature detection correction value are executed. Therefore, more accurate acquisition of the environmental temperature and correction of the head temperature detection means can be achieved.

Second Embodiment

Temperature detection processing also considering exchange of a printhead according to the second embodiment will be described by using the same temperature detection arrangement as that described in the first embodiment with reference to FIG. 12.

Figure 16:
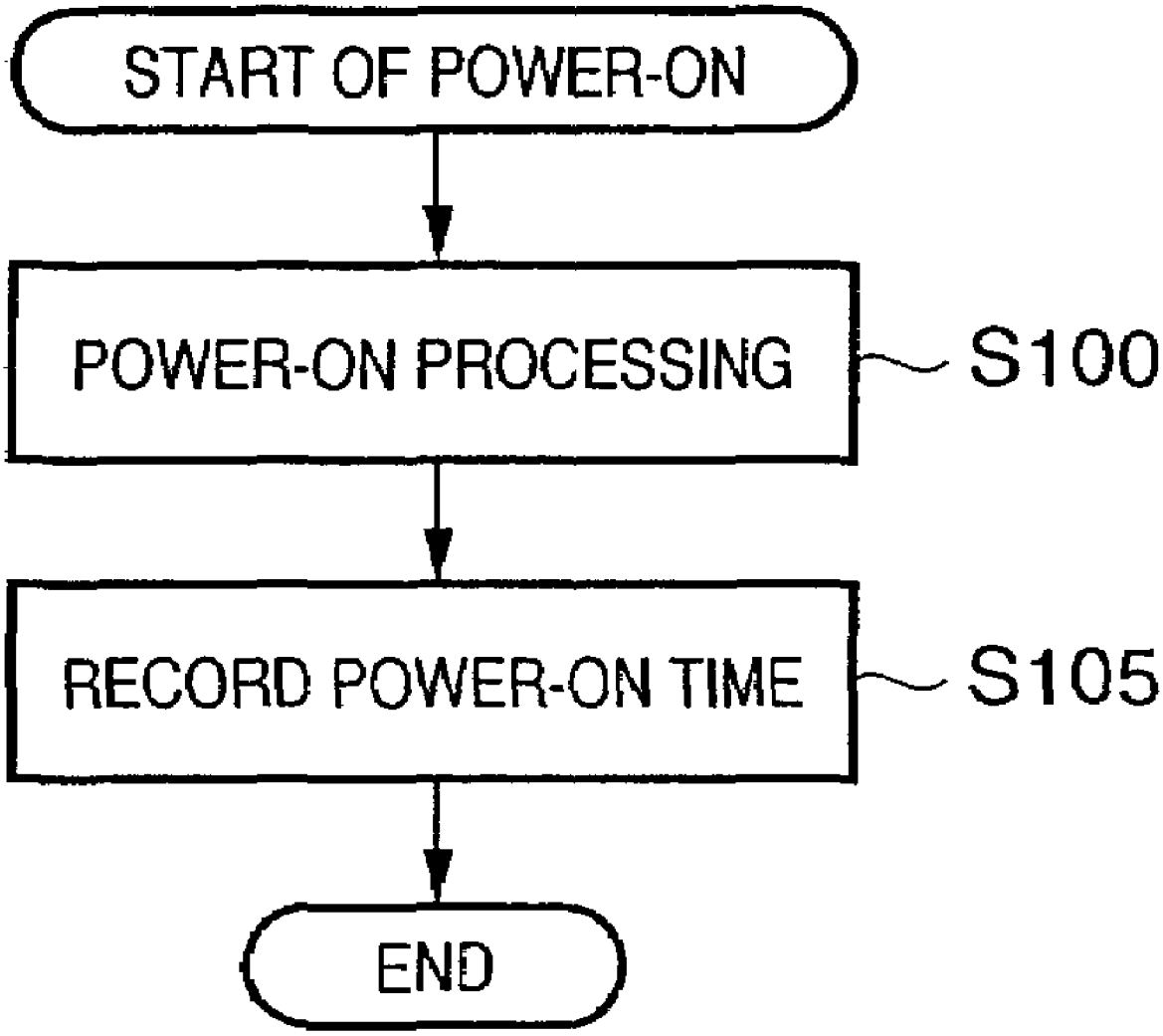
FIG. 16 is a flow chart showing an apparatus activation sequence upon power-on according to a second embodiment of the present invention.

FIG. 16 is a flow chart showing an apparatus activation sequence upon power-on according to the second embodiment. The same step reference numerals as those in FIG. 6 denote the same steps in FIG. 16.

When the printing apparatus is powered on (power-on), various preparation operations (power-on processing) including confirmation of the home position of the carriage position are performed in step S100. In step S105, a power-on time ($T_{pon}$) is acquired by a timer 607 which manages an absolute time, recorded, and stored into the nonvolatile memory 609. After that, power-on processing ends.

Figure 17:
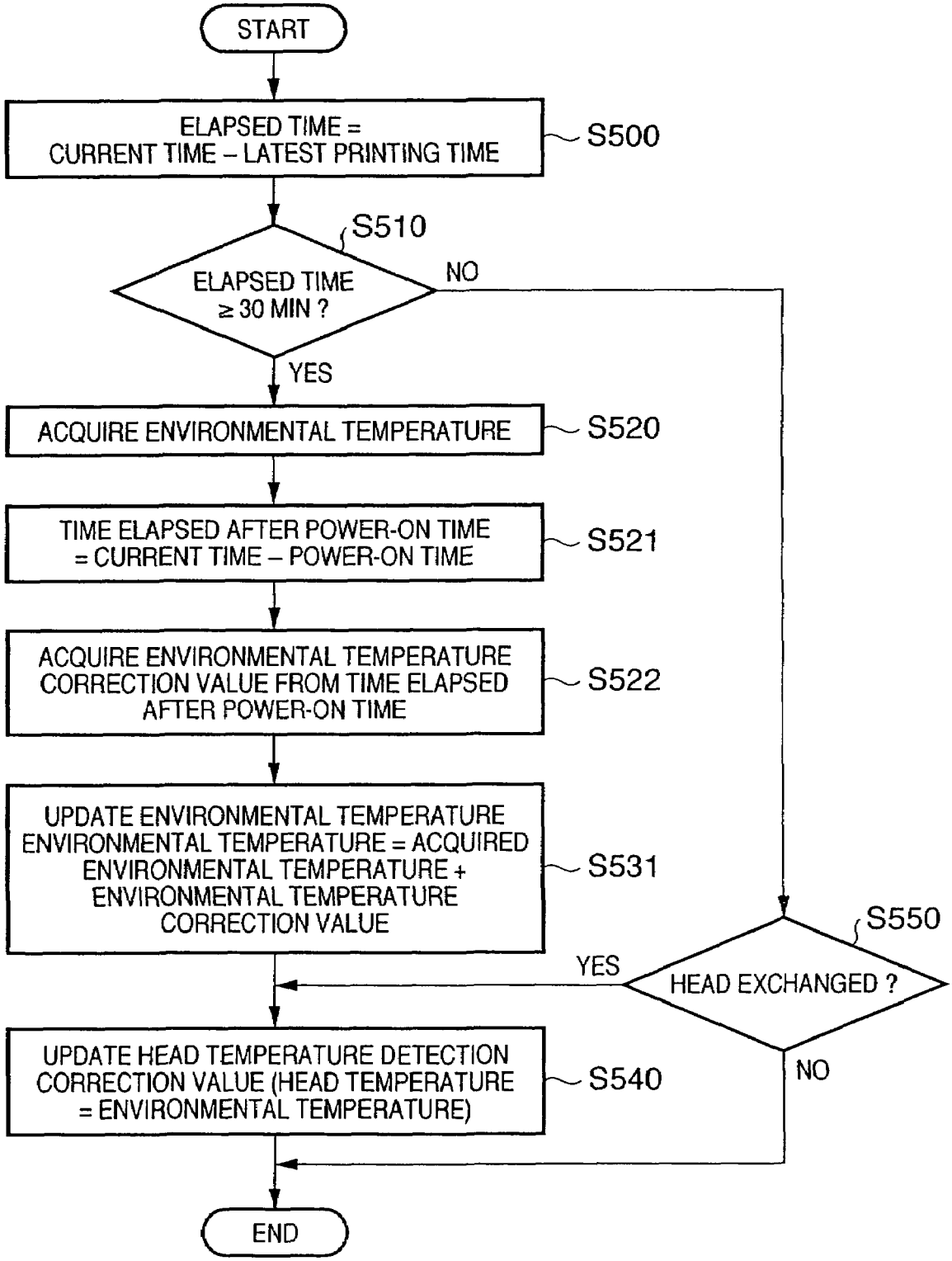
FIG. 17 is a flow chart showing environmental temperature acquisition & head temperature detection correction value update processing according to the second embodiment of the present invention.

FIG. 17 is a flow chart showing environmental temperature acquisition & head temperature detection correction value update processing according to the second embodiment. The same step reference numerals as those in FIG. 14 denote the same steps in FIG. 17.

When the environmental temperature acquisition & head temperature detection correction value update sequence starts, an elapsed time is obtained from the difference between the current time obtained by the timer 607 which manages the absolute time and the latest printing time held in the nonvolatile memory 609 in step S500.

In step S510, whether or not the elapsed value ($T_{laps}$) exceeds 30 minutes is determined.

If $T_{laps} \geqq 30$ minutes, the detected environmental temperature and actual environmental temperature are determined to satisfactorily settle into the equilibrium state. The processing advances to step S520 to acquire an environmental temperature ($T_{ENVR}$). In step S521, a time ($T_{plapse}$) elapsed after power-on is obtained from the difference between the current time ($T_{crnt}$) and the power-on time ($T_{pon}$) which are obtained by the timer 607.

In step S522, an environmental temperature correction value is acquired from the time elapsed after power-on ($T_{plapse}$). The environmental temperature correction value considers, e.g., the substrate temperature which rises along with the time elapsed after power-on. An environmental temperature correction value is acquired in accordance with the time elapsed after power-on by referring to the table shown in FIG. 9. In step S531, the sum of the acquired environmental temperature and environmental temperature correction value is defined as an environmental temperature, and the environmental temperature is updated on the basis of the resultant temperature.

In step S540, the head temperature detection correction value is updated. After that, the processing ends.

If $T_{laps} < 30$ minutes, the processing advances to step S550 to determine whether or not the printhead has been exchanged. The reason why the determination is made is that, if the printhead has been exchanged, the temperature of the new printhead is determined not to rise by printing.

If "YES" in step S550, the processing advances to step S540 to update the head detection correction value. In this case, a head temperature ($T_{HEAD}$) and the environmental temperature ($T_{ENVR}$) are regarded to be equal to each other. The processing then ends. If "NO" in step S550, the influence of a temperature rise by printing still remains in the printhead, and thus the processing ends without acquiring any environmental temperature and updating any head temperature detection correction value.

According to the second embodiment described above, various time counting operations which are generally performed upon soft power-off are eliminated. The latest printing time counted using one timer capable of managing an absolute time is stored in the nonvolatile memory and managed. An elapsed time is obtained from the difference between the latest printing time and the current time. Only when the elapsed time is a predetermined setting time (e.g., 30 minutes) or more, update of the environmental temperature and correction of the head temperature are executed. Even when the elapsed time is shorter than the predetermined setting time, the head temperature is so controlled as to be corrected on the basis of whether or not the printhead has been exchanged. Therefore, a more accurate environmental temperature and head temperature can be detected.

Third Embodiment

Temperature detection processing in an arrangement in which a printing apparatus main body does not have any auxiliary power supply such as a battery but has a nonvolatile memory will be described.

Figure 18:
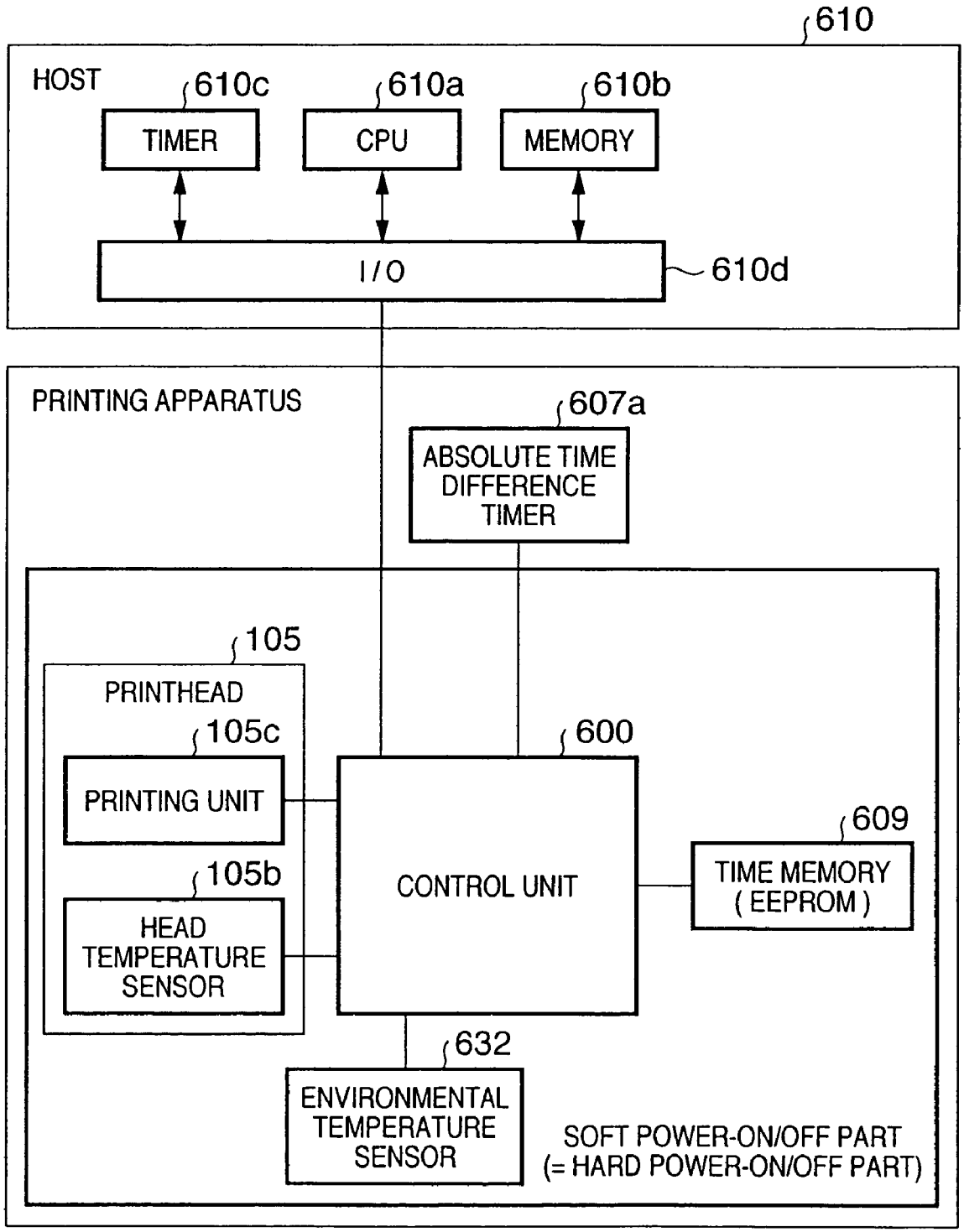
FIG. 18 is a block diagram showing the temperature detection arrangement of a printing apparatus according to a third embodiment of the present invention.

FIG. 18 is a block diagram showing the temperature detection arrangement of a printing apparatus according to the third embodiment of the present invention. A printer 800 has an overall control arrangement shown in FIG. 4. FIG. 18 focuses on only the temperature detection arrangement. The same element reference numerals as in FIG. 12 denote the same elements.

In the third embodiment, the printing apparatus incorporates an absolute printing difference timer 607*a*, while the host device 601 connected to the printing apparatus comprises a timer 610*c* which manages an absolute time. The absolute time can be transferred to the printing apparatus via an I/O interface 610*d* under the control of a CPU 610*a* of the host device 601. Reference numeral 610*b* denotes a memory which stores a program for executing various processes by the CPU 610*a* and is used as a work area for executing the program.

Figure 19:
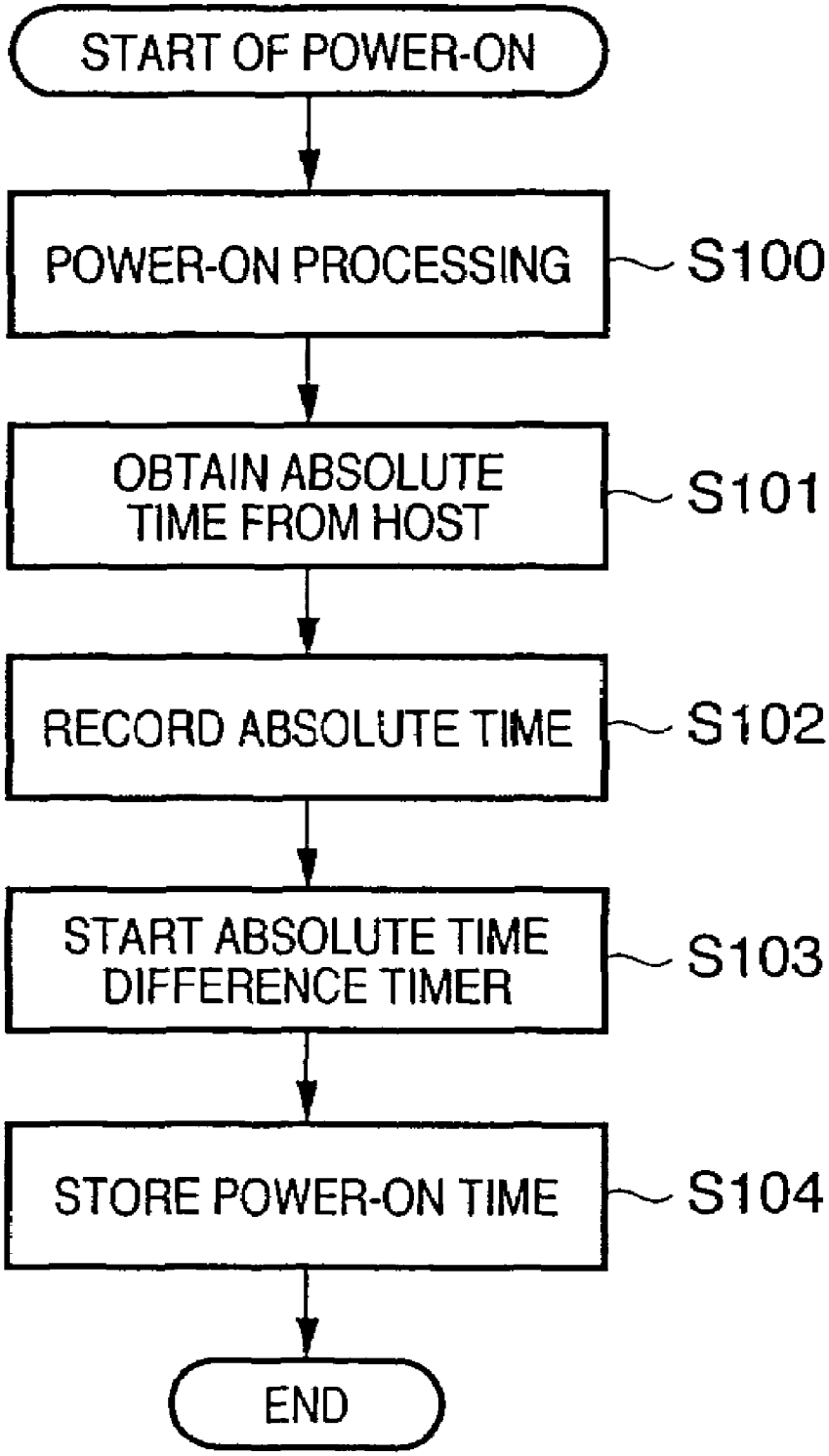
FIG. 19 is a flow chart showing an apparatus activation sequence upon power-on according to the third embodiment of the present invention.

FIG. 19 is a flow chart showing an apparatus activation sequence upon power-on according to the third embodiment. The same step reference numerals as those in FIGS. 6 and 16 denote the same steps in FIG. 19.

When the printing apparatus is powered on (power-on), various preparation operations (power-on processing) including confirmation of the home position of the carriage position are performed in step S100. In step S101, the printing apparatus communicates with the host device 610 to obtain an absolute time ($T_{ab}$) from the host device 610. In step S102, the acquired absolute time is stored in the RAM 604 or nonvolatile memory 609.

In step S103, the absolute time difference timer 607*a* starts. In step S104, relative power-on time ($T_{lpon}$) is acquired using the absolute time difference timer 607*a*, and stored in the RAM 604 or nonvolatile memory 609. Thereafter, power-on processing ends.

Hence, time counting information of the absolute time difference timer 607*a* is a relative time counted from power-on. If an absolute time is necessary, the relative time must be converted into the absolute time in the third embodiment.

Figure 20:
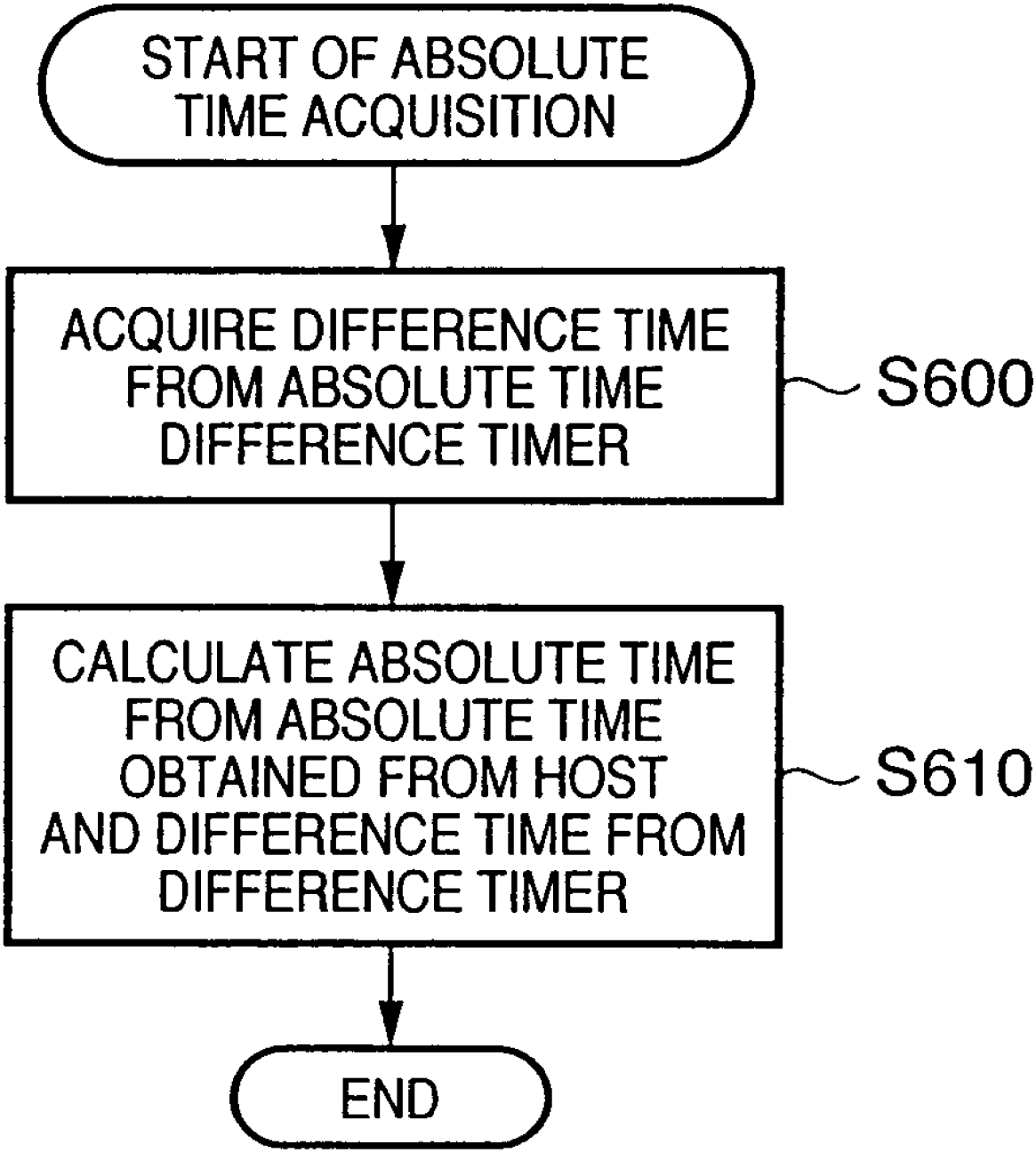
FIG. 20 is a flow chart showing an absolute time acquisition sequence according to the third embodiment of the present invention.

FIG. 20 is a flow chart showing an absolute time acquisition sequence according to the third embodiment.

If the sequence is invoked, a difference time (relative time counted from power-on) is acquired from the absolute time difference timer 607*a* in step S600. In step S610, the absolute current time is calculated from the absolute time ($T_{ab}$) obtained from the host device 610 and the difference time obtained in step S600.

For example, if a power-on time is required as an absolute time, the time is obtained by $T_{ab}+T_{lpon}$.

According to the third embodiment described above, information can be managed by an absolute time even in a case where there is no auxiliary power supply such as a battery in the printing apparatus.

In the above examples, the timing when an absolute time is obtained from the host is a power-on timing. This timing may also be set to another specific timing such as the start of printing or communication with the host.

As many apparently widely different embodiments of the present invention can be made without departing from the spirit and scope thereof, it is to be understood that the invention is not limited to the specific embodiments thereof except as defined in the appended claims.

What is claimed is:

1. A temperature detection method of a printing apparatus which prints by using a printhead, comprising:

a storage step of storing, in a nonvolatile memory, a previous printing time when the printhead has performed a printing operation;

a time acquisition step of acquiring a current time by using a timer which always performs a time counting operation by power supply from an auxiliary power supply capable of supplying power independently of a main power supply that supplies power for performing the printing operation by the printing apparatus;

a calculation step of calculating a time elapsed after the previous printing time on the basis of the current time and the previous printing time;

a comparison step of comparing the elapsed time and a predetermined time;

a measurement step of measuring an environmental temperature by using a sensor arranged in the printing apparatus in accordance with the comparison result in said comparison step;

a detection step of detecting a head temperature using a temperature detection device provided in the printhead, wherein a fluctuation of the detected temperature by the temperature detection device is greater than that by the sensor arranged in the printing apparatus;

an update step of updating a head temperature correction value on the basis of a difference between the environmental temperature measured in said measurement step and the head temperature detected in said detection step in a case where said comparison step determines that the elapsed time exceeds the predetermined time; and a correction step of correcting the detected head temperature with the updated head temperature correction value in the printing operation.

2. The method according to claim 1, wherein the main power supply includes an AC power supply or a DC power supply, and the auxiliary power supply includes a battery.

3. The method according to claim 1, wherein the printhead has a sensor for measuring a head temperature.

4. The method according to claim 1, wherein in said time acquisition step, a power-on time of the printing apparatus is acquired using the timer.

5. The method according to claim 4, wherein in said calculation step, the time elapsed after power-on is calculated from the power-on time and the current time.

6. A printing apparatus which prints by using a printhead, comprising:

a nonvolatile memory which stores a previous printing time when the printhead has performed a printing operation;

a timer which always performs a time counting operation by power supply from an auxiliary power supply capable of supplying power independently of a main power supply that supplies power for performing the printing operation by said printing apparatus;

time acquisition means for acquiring a current time by using said timer;

calculation means for calculating a time elapsed after the previous printing time on the basis of the current time acquired by said time acquisition means and the previous printing time stored in said nonvolatile memory;

comparison means for comparing the elapsed time and a predetermined time;

measurement means for measuring an environmental temperature by using a sensor arranged in said printing apparatus in accordance with the comparison result of said comparison means;

detection means of detecting a head temperature using a temperature detection device provided in the printhead, wherein a fluctuation of the detected temperature by the temperature detection device is greater than that by the sensor arranged in the printing apparatus;

update means for updating a head temperature correction value on the basis of a difference between the environmental temperature measured by said measurement means and the head temperature detected by said detection means in a case where said comparison means determines that the elapsed time exceeds the predetermined time; and correction means for correcting the detected head temperature with the updated head temperature correction value in the printing operation.

* * * * *